US005314791A

United States Patent [19]

Ishikawa et al.

[11] Patent Number: 5,314,791

[45] Date of Patent: May 24, 1994

[54] PROCESSING SOLUTION FOR LIGHT-SENSITIVE SILVER HALIDE COLOR PHOTOGRAPHIC MATERIAL AND PROCESSING METHOD USING THE SAME

[75] Inventors: Masao Ishikawa; Yutaka Ueda; Shigeharu Koboshi, all of Hino, Japan

[73] Assignee: Konica Corporation, Tokyo, Japan

[21] Appl. No.: 940,783

[22] Filed: Sep. 8, 1992

Related U.S. Application Data

[63] Continuation of Ser. No. 649,914, Feb. 4, 1991, abandoned.

[30] Foreign Application Priority Data

Feb. 7, 1990 [JP] Japan ..... 2-29308
Mar. 6, 1990 [JP] Japan ..... 2-56270

[51] Int. Cl.[5] ..... G03C 7/42

[52] U.S. Cl. ..... 430/393; 430/357; 430/455

[58] Field of Search ..... 430/357, 393, 455, 460

[56] References Cited

U.S. PATENT DOCUMENTS

| | | | |
|---|---|---|---|
| 4,059,446 | 11/1977 | Hazenbosch et al. | 430/420 |
| 4,833,069 | 5/1989 | Hamada et al. | 430/505 |
| 5,064,750 | 11/1991 | Naito | 430/393 |
| 5,104,775 | 4/1992 | Abe et al. | 430/393 |

FOREIGN PATENT DOCUMENTS

| | | | |
|---|---|---|---|
| 146136 | 11/1981 | Japan | 430/455 |
| 6840 | 1/1982 | Japan | 430/455 |
| 1306315 | 2/1973 | United Kingdom . | |

*Primary Examiner*—Hoa Van Le
*Attorney, Agent, or Firm*—Frishauf, Holtz, Goodman & Woodward

[57] ABSTRACT

There are disclosed a fixing solution for a light-sensitive silver halide color photographic material which comprises containing a water-soluble surfactant and a processing method using the same.

22 Claims, No Drawings

PROCESSING SOLUTION FOR LIGHT-SENSITIVE SILVER HALIDE COLOR PHOTOGRAPHIC MATERIAL AND PROCESSING METHOD USING THE SAME

This application is a continuation of U.S. application Ser. No. 07/649,914, filed Feb. 4, 1991, now abandoned.

BACKGROUND OF THE INVENTION

This invention relates to a processing solution for a light-sensitive silver halide color photographic material and a processing method using the same, more specifically, it relates to a technique to prevent deposition of a fixing solution and also to prevent fixing at a rack portion or a cross-over portion of an automatic processor.

In a light-sensitive silver halide photographic material, a dye image can be generally formed, after image exposure, by a series of photographic processings comprising a color developing steps and a desilvering step as basic steps.

In the color developing step, according to coupling reaction between an oxidized material of a color developing agent and a color coupler co-presented, a dye image having an image-wise pattern is formed and simultaneously reduced silver is also formed. The silver herein formed is oxidized in the subsequent desilvering step by a bleaching agent and changed to a soluble silver complex by accepting an action of a fixing agent, and then dissolved and washed away in a washing step.

In an automatic processor having such a developing processing step; a washless photofinishing technique having an aim of low pollution has been introduced in recent years. At present, a washless photofinishing system automatic processor has been employed in almost all mini-laboratories. As a reason of such a fact, it can be considered that, in the mini-laboratory market, demands for simplification of processings and saving space for installing the processor are highly requested so that the washless photofinishing system which is plumbing-free satisfies such demands However, after introduction of the washless photofinishing system automatic processor in the mini-laboratory market, there have been found the problems that frictional drag is often generated in an automatic processor for a color negative film, and at worst, transporting of a color film cannot be carried out to cause jamming of the film.

The above problems remarkably decreases commercial value of a color negative film and a color negative film of a client is damaged or a film itself spoiled whereby reliance of a mini-laboratory is markedly injured. Therefore, immediate solution of these problems has been demanded.

SUMMARY OF THE INVENTION

Accordingly, an object of the present invention is to provide a processing solution for a light-sensitive silver halide color photographic material which can prevent occurrence of deposited material in a fixing solution and can prevent occurrence of frictional drag or jamming of a light-sensitive material, and a processing method using the same.

The present inventors have studied concerning the situation of occurrence of frictional drag and jamming in order to solve the above object and found that the above problems have occurred in an automatic processor for a color negative film gradually after about 3 months from introduction of a washless photofinishing system automatic processor in a mini-laboratory, the above problems have never occurred in an automatic processor for a color paper or a so-called volume photofinisher in which centralized processing is carried out with a large scale, and the above problems frequently occurred in a fixing bath.

Also, the present inventors have investigated and analyzed with respect to an automatic processor wherein frictional drag and jamming are actually generated and further an automatic processor for a color paper as well as a large sized automatic processor for a color negative film in a volume photofinisher. As the results, they have found the following matter.

That is, it has been found from the investigation that (1) a large amount of hard deposit occurred at a rack or gear at out of a solution of a fixing bath and further a cross-over rack from the fixing bath to a washing or stabilizing bath, and based on occurrence of the deposit, frictional drag and jamming occurred, and the deposit likely occurred at cross-over portion, (2) a large amount of hard deposit cannot be removed easily and fixedly deposited at the aforesaid portions, and a main component thereof is sulfur, (3) whereas a small amount of deposit, occurred in an automatic processor for a color paper, the degree of the deposit is relatively slight as compared with that of an automatic processor for a color negative film, and (4) in an automatic processor for a color negative film in a volume photofinisher, there are a hanger system and a cine (continuous) system ones. In the case of the hanger system one, the above problems have never occurred since a transporting system by hanging is employed. In the case of the cine system, some fixing material has occurred, but an amount thereof is relatively little compared with an automatic processor for a mini-laboratory and there is no complaint from users as in the hanger system one.

The present invention is based on the above findings and as a result of the inventors earnest studies, the present invention has been accomplished. That is, a fixing solution for a light-sensitive silver halide color photographic material according to the present invention comprises containing a water-soluble surfactant.

Also, as a preferred embodiment of the present invention, in the above fixing solution, the aforesaid light-sensitive silver halide color photographic material is a light-sensitive silver halide color photographic material for photographing, and the aforesaid fixing solution contains $5\times10^{-2}$ mole/l or less of a soluble ferric complex salt and at least 0.2 mole/l of a thiosulfate, and the aforesaid water-soluble surfactant is a nonionic or an anionic surfactant.

Further, a processing method of a light-sensitive silver halide color photographic material of the present invention comprises, in a processing method of a light-sensitive silver halide color photographic material composed of, after subjecting a light-sensitive silver halide color photographic material to imagewise exposure, color developing, bleaching processing with a bleaching solution, and then processing with a fixing solution, followed by washing or processing with a stabilizing solution, the improvement wherein the fixing solution contains a water-soluble surfactant.

Further, as a preferred embodiment, in the above processing method, the aforesaid light-sensitive silver halide color photographic material is a light-sensitive silver halide color photographic material for photographing, a bleaching agent contained in the aforesaid bleaching solution contains a ferric complex salt represented by the following formula (A) or (B), and the aforesaid fixing solution contains at least 0.2 mole/l of a thiosulfate.

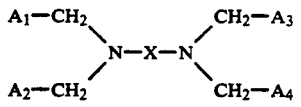

(A)

wherein $A_1$ to $A_4$ may be the same or different and each represent $—CH_2OH$, —COOM or $—PO_3M_1M_2$, where M, $M_1$ and $M_2$ each represent a hydrogen atom, an alkali metal or an ammonium; and X represents a substituted or unsubstituted alkylene group having 3 to 6 carbon atoms.

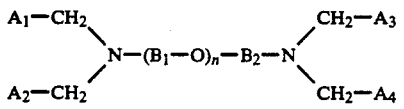

(B)

wherein $A_1$ to $A_4$ have the same meanings as defined in the above formula (A); n is an integer of 1 to 8; $B_1$ and $B_2$ may be the same or different and each represent a substituted or unsubstituted alkylene group having 2 to 5 carbon atoms.

DESCRIPTION OF THE PREFERRED EMBODIMENT

In the present invention, the problems of frictional drag and jamming which are particularly generated in a mini-laboratory and caused by fixing of a component of a fixing solution can be solved by using a specific surfactant. The reason why the above problems can be solved by using such a specific surfactant and a mechanism thereof have not yet been clarified but they would become clear in the future investigation.

Also, it is one of the characteristic features of the present invention that the above fixing phenomenon is particularly generated when a concentration of a soluble iron salt in the fixing solution which fact has been clarified by the investigation and analysis for a long period of term. That is, when a ferric salt is present with a high concentration in a bleach-fixing solution for a color paper and in a subsequent stabilizing solution, deposit hardly occurred since the soluble ferric complex salt would probably act as a buffer to fixing of the deposit. Particularly, it has also been found that use of a soluble ferric complex salt represented by the formula (A) or (B) is effective for preventing fixing in a fixing bath.

Also, as a reason of hardly generating jamming or frictional drag in a volume photofinishing, it has been considered that control of processing solutions such as washing of a transporting rack or cross-over rack can be accurately carried out every day or at regular intervals. To the contrary, in the mini-laboratory market, it has been seldom carried out to open a lid of an automatic processor and washing therein unless any trouble occurred in the automatic processor so that control of a solution in the automatic processor is not carried out.

The present invention has been completed based on the above findings.

It has been known to use a surfactant in a processing solution. For example, in a color developing solution, an alkylbenzene type surfactant is disclosed in Japanese Provisional Patent Publications No. 42154/1987 and No. 42155/1987. Further, in a bleach-fixing solution or a stabilizing solution, a technique in which an ethylene oxide type nonionic surfactant is used is disclosed in Japanese Provisional Patent Publication No. 154153/1989. Also, in Japanese Provisional Patent Publications No. 199346/1983 and No. 17551/1984, a technique in which a nonionic, anionic or cationic surfactant is used in a stabilizing bath in order to improve physical property or image storability after washing or washless processing is disclosed.

However, in Japanese Provisional Patent Publications No. 199346/1983 and No. 17551/1984, a method of using a small amount of surfactant in order to improve solubility of a developing solution or to prevent water spot on a film surface is merely disclosed and the constitution or effects of the present invention is neither disclosed therein.

Also, in Japanese Provisional Patent Publication No. 154153/1989, a method in which mixed processing of a color negative film and a color paper is possible even when low replenishing processing by using a surfactant in a bleach-fixing solution or washless stabilizing solution. However, there is neither disclosed therein to prevent fixing and solidification of a component of the processing solution to a rack by using a surfactant in a fixing solution for a light-sensitive color photographic material and such a fact could never be expected from the conventional knowledge.

In the following, the present invention is described in more detail.

The water-soluble surfactant referred in the present specification means a so-called amphoteric substance, which is water-soluble, having two contradictory groups in solubility to a solvent as a hydrophilic group and a hydrophobic group. A water-soluble surfactant can be classified into an ionic surfactant and a nonionic surfactant according to its property that it shows ionic property in an aqueous solution or not. The ionic surfactant can be further classified into an anionic surfactant, a cationic surfactant and amphoteric surfactant according to a kind of ion at a part showing a surfactant property in an aqueous solution. In the present invention, either of the above surfactants can be used to accomplish the objects of the present invention, and two or more kinds thereof may be combinedly used.

As a surfactant to be preferably used in the present invention, there may be mentioned compounds represented by the following formulae (I) to (X) and (XI).

$$A_2—O—(B)_m—(C)_n—X_1 \quad (I)$$

In the formula, $A_2$ represents a monovalent organic group such as an alkyl group having 6 to 50, preferably 6 to 35 carbon atoms (e.g. each group of hexyl, heptyl, octyl, nonyl, decyl, undecyl or dodecyl) and an aryl group substituted by an alkyl group having 3 to 35 carbon atoms or by an alkenyl group having 2 to 35 carbon atoms.

As the preferred substituents on the aryl group, there may be mentioned an alkyl group having 1 to 18 carbon atoms (e.g. unsubstituted alkyl group such as methyl, propyl, butyl, pentyl, hexyl, heptyl, octyl, nonyl, decyl, undecyl and dodecyl), a substituted alkyl group such as benzyl and phenethyl, or an alkenyl group having 2 to 20 carbon atoms (e.g. unsubstituted alkenyl groups such as oleyl, cetyl and allyl, and substituted alkenyl groups such as styryl). As the aryl group, there may be mentioned each group of phenyl, biphenyl and naphthyl, and preferably a phenyl group. As the position to be substituted on the aryl group, either of ortho, meta or para may be substituted and plural number of groups may be substituted.

B or C represents ethylene oxide or propylene oxide, or $$-(CH_2)_{n1}-\underset{\underset{OH}{|}}{(CH)}_{m1}-(CH_2)_{l1}-O-$$

where $n_1$, $m_1$ and $l_1$ each represent 0, 1, 2 or 3.

m and n each represent an integer of 0 to 100.

$X_1$ represents a hydrogen atom, an alkyl group, an aralkyl group or an aryl group, and for example, there may be mentioned groups as explained in $A_2$.

$$R^1X(E^1)_{l1}(E^2)_{m1}(E^3)_{n1}-R^2 \quad \text{(II)}$$

In the formula, $R^1$ represents a hydrogen atom, an aliphatic group or an acyl group, $R^2$ represents a hydrogen atom or an aliphatic group, $E^1$ represents ethylene oxide, $E^2$ represents propylene oxide, $E^3$ represents ethylene oxide, X represents a carboxyl group, —O— or a $-NR^3-$ group where $R^3$ represents an aliphatic group, a hydrogen atom or $$(E^1)_{l2}(E^2)_{m2}(E^3)_{n2}-R^4,$$

where $R^4$ represents a hydrogen atom or an aliphatic group, and l1, l2, m1, m2, n1 and n2 each represent an integer of 0 to 100.

$$R^1(X-L)_l COOM \quad \text{(III)}$$

In the formula, $R^1$ represents an aliphatic group (e.g. a saturated or unsaturated, substituted or unsubstituted, straight or branched alkyl group), X represents $$-\underset{\underset{R^2}{|}}{CON}- \quad \text{or} \quad -\underset{\underset{R^3}{|}}{SO_2N}-$$

(where $R^2$ and $R^3$ each represent a hydrogen atom or the group defined in $R^1$), l is 0 or 1, M represents a hydrogen atom, an alkali metal (Na or K), an ammonium ion or an organic ammonium ion, and L represents an alkylene group.

$$R^1(X-L)_l(Y)_{m'}-SO_3M \quad \text{(IV)}$$

In the formula, $R^1$ represents an aliphatic group (e.g. a saturated or unsaturated, substituted or unsubstituted, straight or branched alkyl group), X represents $$-\underset{\underset{R^2}{|}}{CON}-, \quad -\underset{\underset{R^3}{|}}{SO_2N}- \quad \text{or} \quad -COO-$$

(where $R^2$ and $R^3$ each represent a hydrogen atom or the group defined in $R^1$), l and m' are each 0 or 1, L represents an alkylene group, Y represents an oxygen atom and M represents an alkali metal (Na, K and Li).

$$A_2-O(CH_2CH_2O)_n SO_3M \quad \text{(V)}$$

In the formula, M represents an alkali metal (Na, K and Li), n is 1 to 100, $A_2$ represents a monovalent organic group such as an alkyl group having 6 to 20, preferably 6 to 12 carbon atoms (e.g. each group of hexyl, heptyl, octyl, nonyl, decyl, undecyl and dodecyl), or an aryl group substituted by an alkyl group having 3 to 20 carbon atoms, and as the substituents, there may be preferably mentioned an alkyl group having 3 to 12 carbon atoms (e.g. each group of propyl, butyl, pentyl, hexyl, heptyl, octyl, nonyl, decyl, undecyl and dodecyl), and as the aryl group, there may be mentioned each group of phenyl, tolyl, xylyl, biphenyl and naphthyl, preferably a phenyl group or a tolyl group. As the position of the alkyl group to be bonded on the aryl group, either of ortho, meta or para may be substituted.

$$R_5-\overset{\overset{R_4}{|}}{\underset{\underset{R_6}{|}}{N^{\oplus}}}-A-COO^{\ominus} \quad \text{(VI)}$$

In the formula, $R_4$, $R_5$ and $R_6$ each represent a substituted or unsubstituted alkyl group, and $R_4$ and $R_5$, or $R_5$ and $R_6$ may form a ring, respectively. A represents $$-\underset{\underset{R_7}{|}}{(CH)}_n-$$

(where $R_7$ represents a hydrogen atom or an alkyl group and n is an integer of 1, 2 or 3).

$$R_1-\underset{\underset{(R_2)_m}{|}}{N}(A-X)_n \quad \text{(VII)}$$

In the formula, $R_1$ has the same meaning as $A_2$ in the formula (II), $R_2$ represents a hydrogen atom or an alkyl group (e.g. a methyl group and an ethyl group), m and n are each 0, 1 or 2, A represents an alkyl group or a substituted or unsubstituted aryl group and X is —COOM or $-SO_3H$ where M is a hydrogen atom or an alkali metal.

$$R_5-\overset{\overset{R_4}{|}}{\underset{\underset{R_6}{|}}{N^{\oplus}}}-R_7.X^{\ominus} \quad \text{(VIII)}$$

In the formula, $R_4$, $R_5$, $R_6$ and $R_7$ each represent a hydrogen atom, a substituted or unsubstituted alkyl group or a phenyl group, $X^{\ominus}$ represents an anion of a halogen atom, a hydroxyl group, a sulfate group, a carbonate group, a nitrate group, an acetate group or a p-toluenesulfonate group.

$$\begin{array}{l} R_6-CH-COA_1R_8 \\ \quad\;\; | \\ R_7-CH-COOR_9 \end{array} \quad \text{(IX)}$$

In the formula, one of $R_6$ and $R_7$ represents a hydrogen atom or an alkyl group and the other represents a group represented by the formula: $-SO_3M$ (where M represents a hydrogen atom or a monovalent cation), $A_1$ represents an oxygen atom or a group represented by the formula: $-NR_{10}$ (where $R_{10}$ represents a hydrogen atom or an alkyl group having 1 to 8 carbon atoms), and $R_8$ and $R_9$ each represent an alkyl group having 4 to 30 carbon atoms, provided that the alkyl group represented by $R_8$, $R_9$ or $R_{10}$ may be substituted by a fluorine atom.

(X)

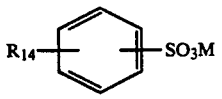

(XI)

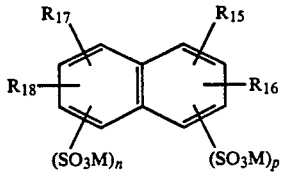

In the formulae, $R_{14}$, $R_{15}$, $R_{16}$, $R_{17}$ and $R_{18}$ each represent a hydrogen atom or an alkyl group, M has the same meaning with M as defined in the formula (III), and n and p are each of integer of 0 or 1 to 4 and numbers satisfying $1 \leqq n+p \leqq 8$.

In the following, exemplary compounds represented by the formulae (I) to (X) and (XI) are enumerated but the present invention is not limited by these.

(Compound represented by the formula (I))

$C_{12}H_{25}-O-(C_2H_4O)_{10}-H$ I-1

$C_8H_{17}-O-(C_3H_6O)_{15}-H$ I-2

$C_9H_{19}-O-(C_2H_4O)_4-H$ I-3

$C_{10}H_{21}-O-(C_2H_4O)_{15}-H$ I-4

I-5

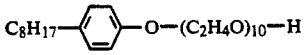

I-6

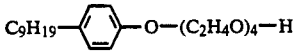

I-7

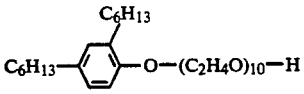

I-8

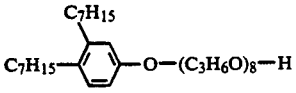

I-9

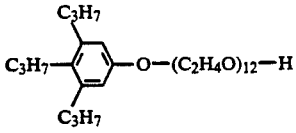

I-10

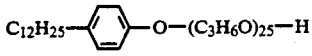

I-11

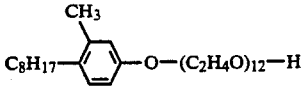

-continued

I-12

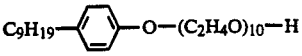

I-13

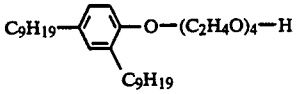

$C_{12}H_{25}O-(C_2H_4O)_4-H$ I-14

$C_6H_{13}O-(C_2H_4O)_{10}-H$ I-15

$C_8H_{17}O-(C_2H_4O)_{15}-H$ I-16

$C_{10}H_{21}O-(C_2H_4O)_{10}-H$ I-17

$C_{12}H_{25}O-(C_2H_4O)_{15}-H$ I-18

$C_{14}H_{29}O-(C_2H_4O)_{15}-H$ I-19

I-20

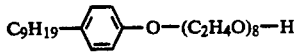

I-21

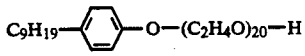

I-22

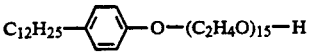

I-23

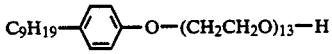

I-24

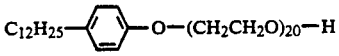

I-25

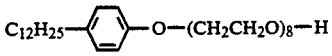

I-26

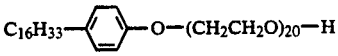

I-27

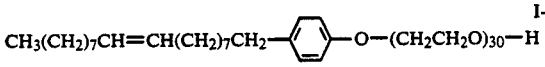

I-28

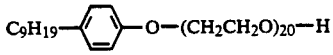

I-29

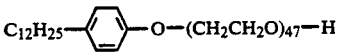

I-30

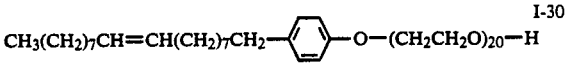

I-31

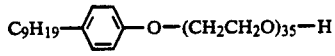

I-32

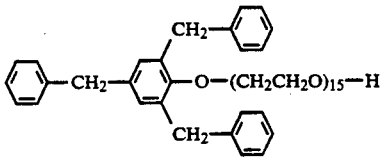

I-33

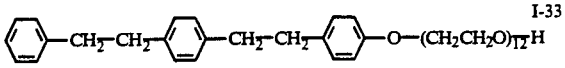

I-34

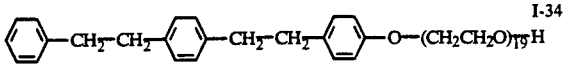

-continued
I-35
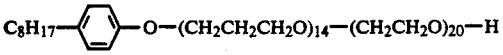
I-36
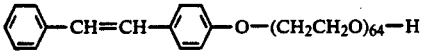
I-37
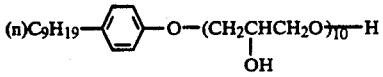
I-38
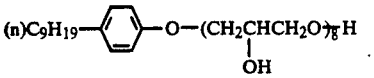
I-39
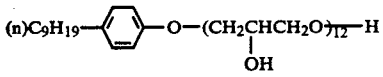
I-40
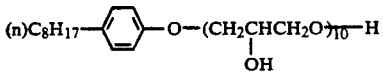
I-41
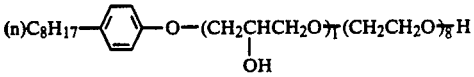
I-42
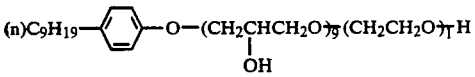
I-43
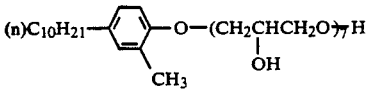
I-44
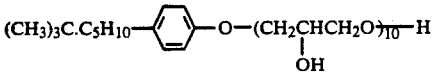
I-45
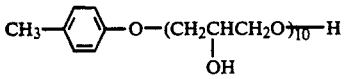
I-46 $(n)C_{13}H_{27}-O-(CH_2CH_2O)_5-H$
I-47 $C_{12}H_{25}-O-(CH_2CH_2O)_{10}-H$
I-48 $C_{18}H_{37}-O-(CH_2CH_2O)_{10}-H$
I-49 $(n)C_{10}H_{21}-O-(CH_2CH_2O)_4-H$
I-50 $(n)C_{16}H_{33}-O-(CH_2CH_2O)_4-H$
I-51 $(n)C_{12}H_{25}-O-(CH_2CHCH_2O)_{10}-H$ (OH)
I-52
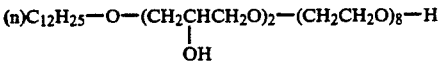
I-53 $(n)C_{13}H_{27}-O-(CH_2CH_2O)_4-H$
I-54
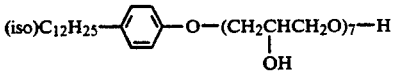
I-55
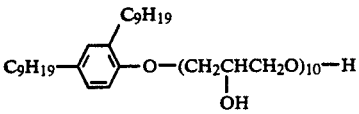
I-56
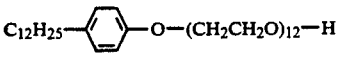
-continued
I-57
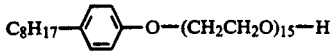
I-58
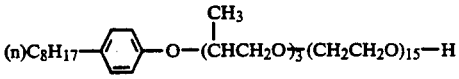
I-59
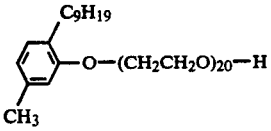
I-60
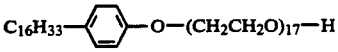
I-61
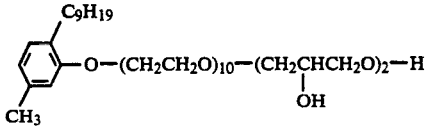
I-62
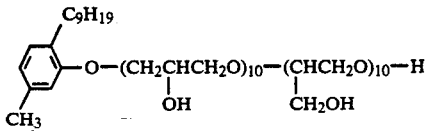
I-63
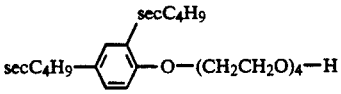
I-64
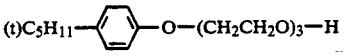
I-65
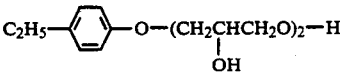
I-66
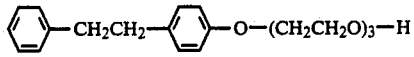
I-67
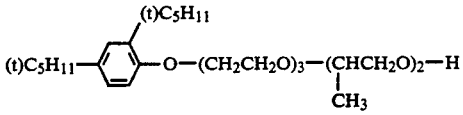
I-68
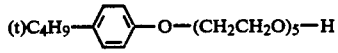
I-69
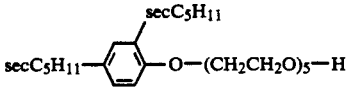
I-70
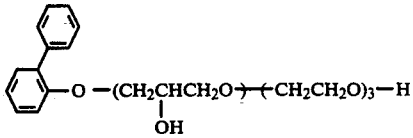
I-71
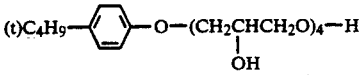

-continued

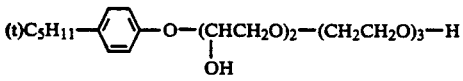

I-72

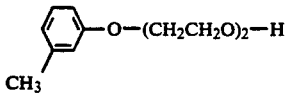

I-73

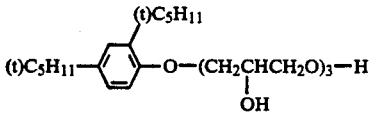

I-74

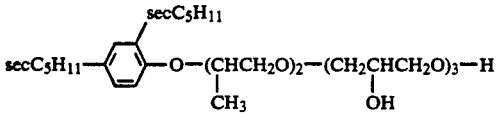

I-75

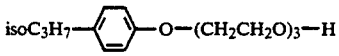

I-76

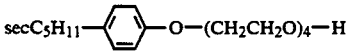

I-77

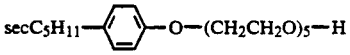

I-78

(Compounds represented by the formula (II))

$C_{12}H_{25}COO—(C_2H_4O)_{10}—H$ II-1

$C_9H_{19}COO—(C_2H_4O)_4—H$ II-2

$C_{12}H_{25}NH—(C_2H_4O)_{10}—H$ II-3

$C_{12}H_{25}NH—(C_2H_4O)_{15}—H$ II-4

$HO—(C_2H_4O)_{20}—(CHCH_2O)_5—(C_2H_4O)_{20}—H$ (CH3) II-5

$C_{12}H_{25}NHCH_2CH_2OH$ II-6

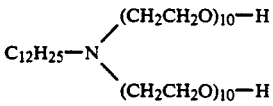

II-7

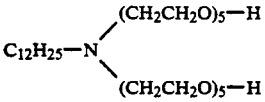

II-8

(Compounds represented by the formula (III))

$C_{12}H_{25}—SO_2NHCH_2CH_2COONa$ III-1

$C_{12}H_{25}COONa$ III-2

$C_{12}H_{25}COOK$ III-3

$C_{17}H_{33}CONHCH_2CH_2COONa$ III-4

$C_{17}H_{33}CON—CH_2COONa$ (CH3) III-5

$C_{17}H_{33}CON—CH_2COOH$ (CH3) III-6

(Compounds represented by the formula (IV))

-continued $C_{12}H_{25}SO_3Na$ IV-1

$C_{11}H_{23}CONHCH_2CH_2OSO_3Na$ IV-2

$C_{12}H_{25}CONH—(CH_2CH_2O)_n—SO_3Na$ IV-3

$C_{12}H_{25}OSO_3Na$ IV-4

$C_{11}H_{23}COOCH_2CH(OH)CH_2OSO_3Na$ IV-5

$C_{11}H_{23}—CON—CH_2CH_2SO_3Na$ (CH3) IV-6

$C_{15}H_{31}—CON—CH_2CH_2SO_3Na$ ($CH_2CH_2OH$) IV-7

$C_{17}H_{35}—CON—CH_2CH_2SO_3Na$ (C6H5) IV-8

$C_{17}H_{35}—CON—CH_2CH_2SO_3K$ ($C_4H_9$) IV-9

$C_{11}H_{23}—CON—CH_2SO_3Na$ (CH3) IV-10

$C_{15}H_{31}—CON—CH_2CH_2SO_3Na$ (CH3) IV-11

(Compounds represented by the formula (V))

$C_9H_{19}O(C_2H_4O)_4SO_3Na$ V-1

$C_{10}H_{21}O(C_2H_4O)_{15}SO_3Na$ V-2

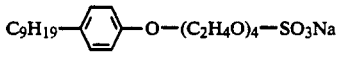

V-3

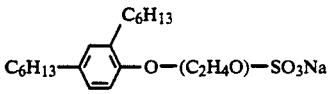

V-4

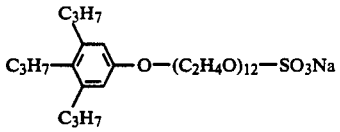

V-5

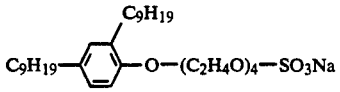

V-6

$C_{12}H_{25}O—(C_2H_4O)_4—SO_3Na$ V-7

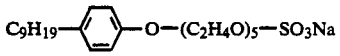

V-8

(Compounds represented by the formula (VI))

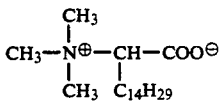

VI-1

-continued
VI-2
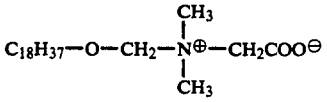
VI-3
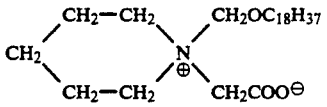
VI-4
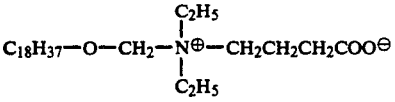
VI-5
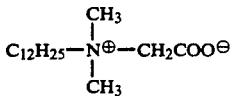
VI-6
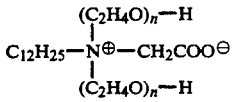
(Compounds represented by the formula (VII))
VII-1 $C_{12}H_{25}-N-(CH_2CH_2COONa)_2$
VII-2 $C_{17}H_{35}NHCH_2CH_2SO_3Na$
VII-3
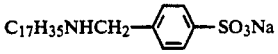
(Compounds represented by the formula (VIII))
VIII-1
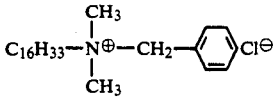
VIII-2
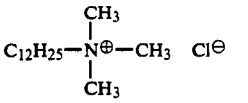
VIII-3
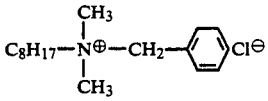
VIII-4
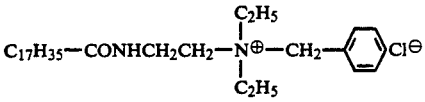
VIII-5
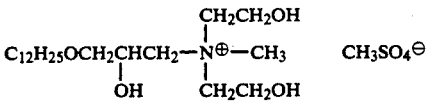
VIII-6
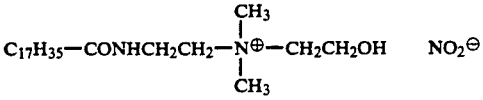
VIII-7
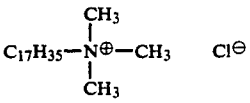
-continued
VIII-8
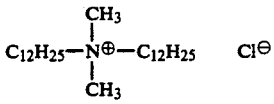
VIII-9
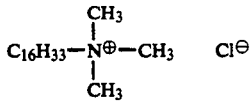
VIII-10
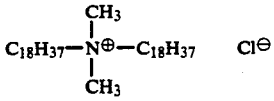
VIII-11
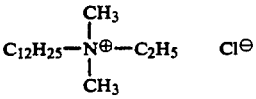
VIII-12
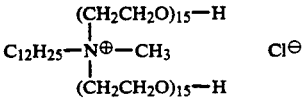
VIII-13
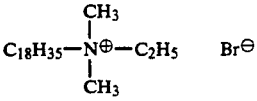
VIII-14
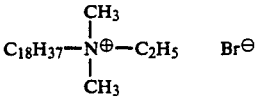
VIII-15
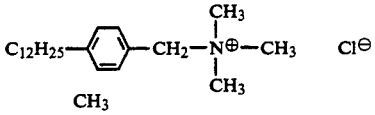
VIII-16
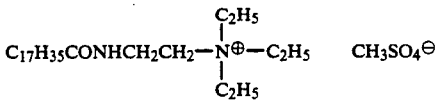
VIII-17
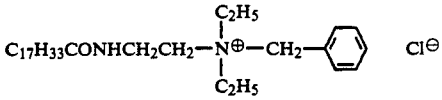
VIII-18
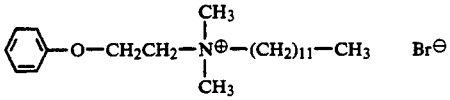
VIII-19
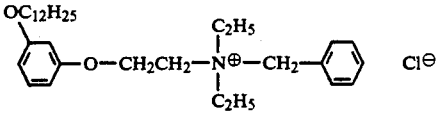
VIII-20
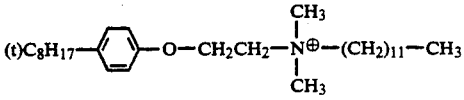
VIII-21
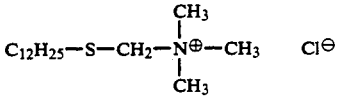

-continued
VIII-22
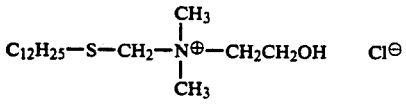
VIII-23
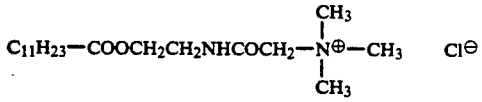
VIII-24
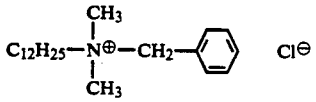
VIII-25
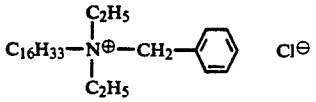
VIII-26
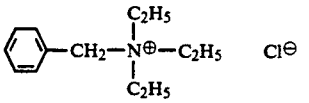
VIII-27
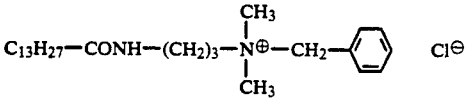
(Compound represented by the formula (IX))
IX-1
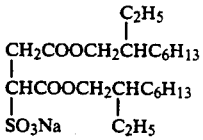
IX-2
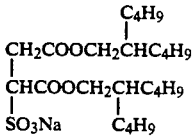
IX-3
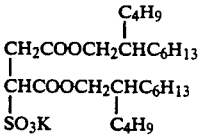
IX-4
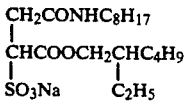
IX-5
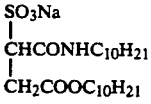
IX-6
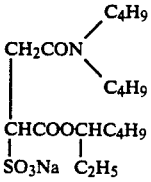
-continued
IX-7
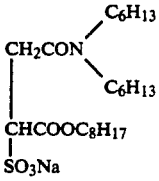
IX-8
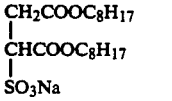
IX-9
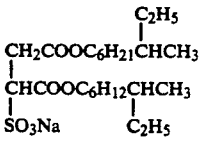
IX-10
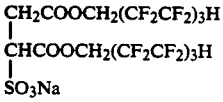
IX-11
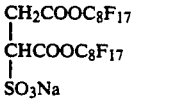
IX-12
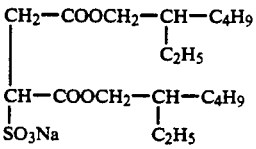
IX-13
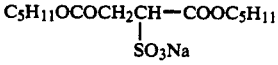
IX-14
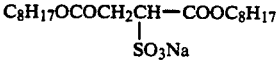
IX-15
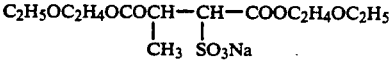
IX-16
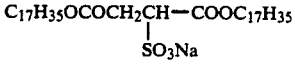
IX-17
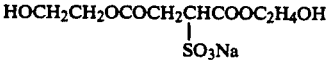
(Compound represented by the formula (X))
X-1
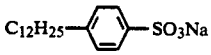
X-2
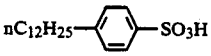
(Compound represented by the formula (XI))
XI-1
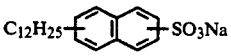
XI-2
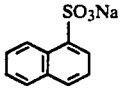

-continued

XI-3

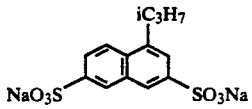

XI-4

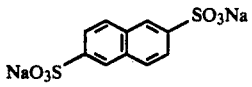

XI-5

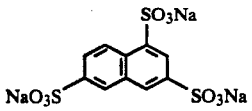

XI-6

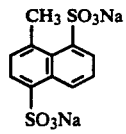

XI-7

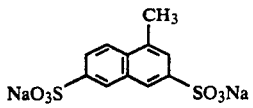

XI-8

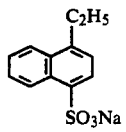

XI-9

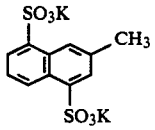

XI-10

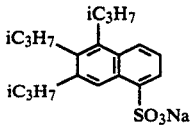

XI-11

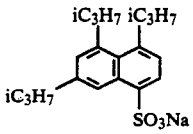

An amount of the water-soluble surfactant to be used in the fixing solution of the present invention is 0.05 to 10 g/l preferably 0.1 to 8 g/l. If it is less than 0.05 g/l remarkable effect of the present invention cannot be expected, while if it exceeds 10 g/l solubility becomes low so that it is not practical.

Also, an amount of the water-soluble surfactant may be in the range of 0.05 to 10 g per liter including a surfactant dissolved out from a light-sensitive silver halide color photographic material, but in order to accomplish the effect of the present invention as mentioned above, it is particularly preferred to previously add the above amount in the fixing solution. That is, the water-soluble surfactant dissolved out from a light-sensitive material is accumulated in the fixing solution according to the continuous processing while it is a small amount, but the effect thereof is markedly different from the case where it is previously added in the fixing solution.

The water-soluble surfactant to be used in the present invention should be contained at least one kind, but it may be contained two or more in combination, in summary, it is sufficient so long as it is contained in the range of 0.05 to 10 g per liter of the fixing solution.

Preferred water-soluble surfactant to be used in the present invention is a nonionic surfactant and an anionic surfactant. When the cationic surfactant is added in the fixing solution, precipitation sometimes occurs depending on the kind of the surfactant and the effect of the present invention is not so remarkable.

In the present invention, the effects of the present invention become remarkable when an amount of a soluble ferric complex salt to be contained in the fixing solution brought from a previous bleaching solution into therein is $5\times10^{-2}$ mole/liter or less. That is, fixing and adhering phenomenon in the fixing bath is correlated with a concentration of the soluble ferric complex salt to a certain extent and when the concentration of the soluble ferric complex salt is low, fixing and adhering phenomenon at the neighbor of the fixing bath becomes remarkable. However, when it is $5\times10^{-2}$ mole/liter or more, a degree of fixing and adhering becomes slight. Accordingly, when a low concentration as $5\times10^{-2}$ mole/liter or less of the soluble ferric complex salt is contained, occurrence of the fixing and adhering phenomenon can be prevented by using a surfactant of the present invention.

Also, the fixing solution of the present invention preferably contains at least 0.2 mole/liter of a thiosulfate, more preferably 0.5 to 3.0 mole/liter, particularly preferably 0.8 to 2.5 mole/liter whereby the effects of the present invention become remarkable. When no surfactant of the present invention is contained in the fixing solution, if 0.2 mole/liter or more of a thiosulfate is contained therein, fixing and adhering state becomes rapidly worse within a short term. However, when the surfactant of the present invention is added to the fixing solution, the fixing and adhering state becomes good during a long period of processing even when 0.2 mole/liter or more of a thiosulfate is contained.

The bleaching agent to be used in the bleaching solution in the present invention may be mentioned a ferric complex salt of an organic acid represented by the above formula (A) or (B) and a ferric complex salt of the exemplary compounds represented by the A'- 1 to 16, etc. mentioned hereinbelow, but preferably a ferric complex salt of an organic acid represented by the above formula (A) or (B).

In the following, the compound represented by the formula (A) is described.

In the above formula (A), $A_1$ to $A_4$ may be the same or different and each represent —$CH_2OH$, —COOM or —$PO_3M_1M_2$, where M, $M_1$ and $M_2$ each represent a hydrogen atom, an alkali metal (e.g. sodium and potassium) or an ammonium. X represents a substituted or unsubstituted alkylene group having 3 to 6 carbon atoms (e.g. propylene, butylene and pentamethylene). As a substituent, there may be mentioned a hydroxyl group and an alkyl group having 1 to 3 carbon atoms.

In the following, preferred exemplary compounds represented by the formula (A) are enumerated.

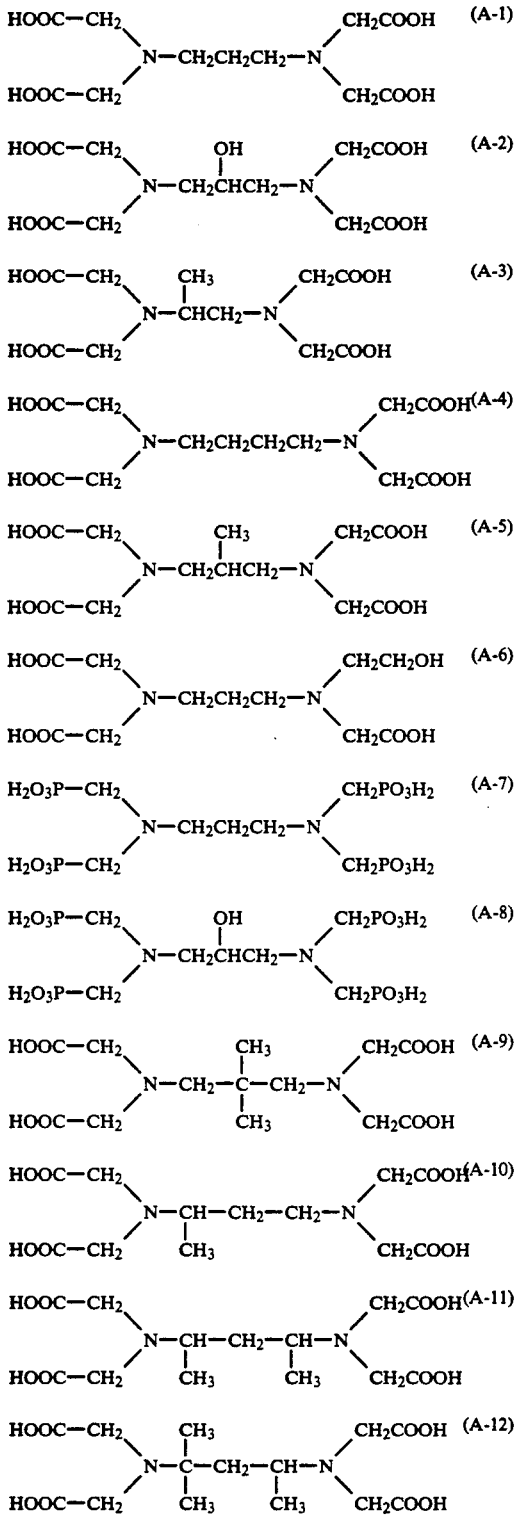

As a ferric complex salt of these compounds (A - 1) to (A - 12), sodium salt, potassium salt or ammonium salt of these ferric complex salts can be optionally employed. From aspects of the effects of the present invention and solubility, ammonium salts of these ferric complex salts can be preferably used.

Of these compounds mentioned above, those particularly preferably employed in the present invention is (A - 1), (A - 3), (A - 4), (A - 5) and (A - 9), and above all, particularly preferred is (A - 1).

Next, the compound represented by the formula (B) is described in detail below.

In the formula, $A_1$ to $A_4$ have the same meanings as defined in the above formula (A), n is an integer of 1 to 8. $B_1$ and $B_2$ may be the same or different and each represent a substituted or unsubstituted alkylene group having 2 to 5 carbon atoms (e.g. ethylene, propylene, butylene and pentamethylene). As the substituent, there may be mentioned a hydroxyl group and a lower alkyl group having 1 to 3 carbon atoms (methyl group, ethyl group and propyl group).

In the following, preferred exemplary compounds represented by the formula (B) are enumerated.

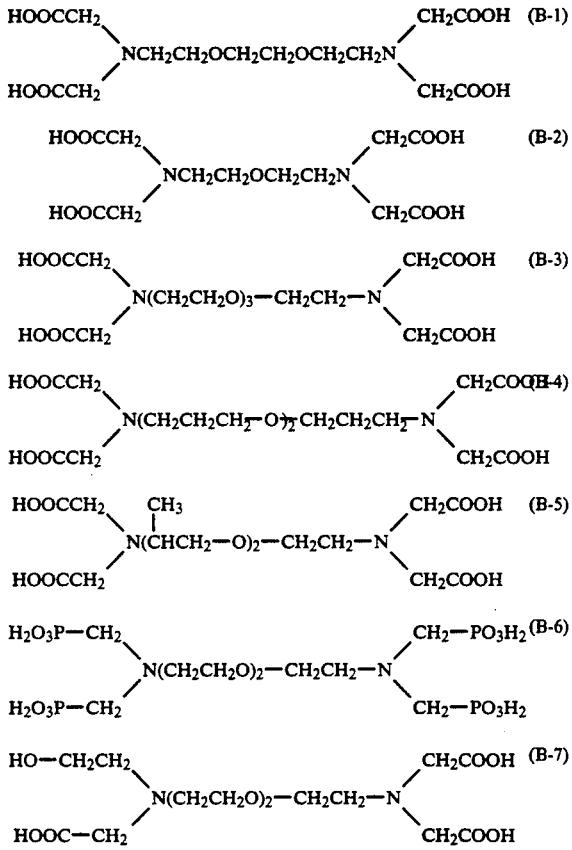

As a ferric complex salt of these compounds (B - 1) to (B - 7), sodium salt, potassium salt or ammonium salt of these ferric complex salts can be optionally empolyed. In the present invention, it is a preferred embodiment that an amount of the ammonium salt is 50 mole % or less, more preferably 20 mole % or less, particularly preferably 10 mole % or less from the aspects that an oxidizing power of the aforesaid bleaching agent is sufficiently high and bleach fog is likely caused when an ammonium salt is used.

Of these compounds mentioned above, those particularly preferably employed in the present invention is (B - 1), (B -2) and (B - 7), and above all, particularly preferred is (B - 1).

An amount of the organic acid ferric complex salt is preferably in the range of 0.1 mole to 2.0 mole per liter of the bleaching solution, more preferably in the range of 0.15 to 1.5 mole/liter.

In the bleaching solution of the present invention, preferred bleaching agent other than the above compounds represented by the formulae (A) and (B) may be exemplified by a ferric complex salts of the following compounds (e.g. a salt of ammonium, sodium, potassium and triethanolamine), but the present invention is not limited by these.

(A'- 1) Ethylenediaminetetraacetic acid
(A'- 2) Trans-1,2-cyclohexanediaminetetraacetic acid
(A'- 3) Dihydroxyethylglycine acid
(A'- 4) Ethylenediaminetetrakismethylenephosphonic acid
(A'- 5) Nitrilotrismethylenephosphonic acid
(A'- 6) Diethylenetriaminepentakismethylenephosphonic acid
(A'- 7) Diethylenetriaminepentaacetic acid
(A'- 8) Ethylenediaminediorthohydroxyphenylacetic acid
(A'- 9) Hydroxyethylethylenediaminetriacetic acid
(A'- 10) Ethylenediaminedipropionic acid
(A'- 11) Ethylenediaminediacetic acid
(A'- 12) Hydroxyethyliminodiacetic acid
(A'- 13) Nitrilotriacetic acid
(A'- 14) Nitrilotripropionic acid
(A'- 15) Triethylenetetraminehexaacetic acid
(A'- 16) Ethylenediaminetetrapropionic acid In the bleaching solution of the present invention, the ferric complex salt of the compound represented by the above formula (A) or (B) can be used in combination with one or more of the ferric complex salt of the compound (A'- 1) to (A'- 16) mentioned above.

When the organic acid ferric complex salts are used in combination with two or more, it is preferred to use 70% (in terms of mole) or more of the ferric complex salt of the compound represented by the above formula (A) or (B), more preferably 80% or more, particularly preferably 90% or more, most preferably 95% or more in order to accomplish the effects of the present invention more effectively.

Also, in view of rapid processing, it is a preferred embodiment of the present invention that an ammonium is contained as a cation in the bleaching solution with an amount of 70% or more, preferably 85% or more, particularly preferably 90% or more.

The organic acid iron (III) complex salt may be used in the form of a complex salt, or may be used an iron (III) salt such as ferric sulfate, ferric chloride, ferric acetate, ammonium ferric sulfate and ferric phosphate with an aminopolycarboxylic acid or a salt thereof to form an iron (III) ion complex salt in a solution. Also, when it is used in the form of a complex salt, one kind of complex salt may be used or two or more kinds of complex salts may be combinedly used. Further, when a complex salt is formed in a solution by using a ferric salt and an aminopolycarboxylic acid, one or more kinds of ferric salts may be used. Furthermore, one or more kinds of aminopolycarboxylic acids may be used. Also, in either of the cases, an excess amount of an aminopolycarboxylic acid may be used than forming an iron (III) ion complex salt.

Also, in the bleach-fixing solution or the bleaching solution containing the above iron (III) ion complex, other metal ion complex salts such as cobalt, copper, nickel and zinc other than iron may be contained.

To the bleaching solution, an imidazole or a derivative thereof, or compounds represented by the formulae (I) to (IX) and at least one of the exemplary compounds thereof disclosed in Japanese Provisional Patent Publication No. 295258/1989 may be added whereby rapid processing can be achieved.

Other than the above bleaching accelerators, exemplary compounds disclosed at pages 51 to 115 of Japanese Provisional Patent Publication No. 123459/1987, exemplary compounds disclosed at pages 22 to 25 of Japanese Provisional Patent Publication No. 17445/1988 and compounds disclosed in Japanese Provisional Patent Publications No. 95630/1978 and No. 28426/1978 may be also similarly used.

These bleaching accelerators may be used alone or in combination of two or more kinds thereof. An amount thereof is generally preferably in the range of about 0.01 to 100 g, more preferably 0.05 to 50 g, particularly preferably 0.05 to 15 g per liter of the bleaching solution.

When the bleaching accelerator is added, it may be added directly and dissolved, but generally added by previously dissolving in water, an alkali or an organic acid, and also it may be added by dissolving an organic solvent such as methanol, ethanol and acetone, if necessary.

A temperature of the bleaching solution to be used is preferably 20° C. to 50° C., and desirably 25° C. to 45° C.

A pH of the bleaching solution is preferably 6.0 or less, more preferably in the range of 1.0 to 5.5.

The pH of the bleaching solution is a pH of the processing tank at processing of a light-sensitive silver halide material which is clearly distinguished from a pH of a so-called replenishing solution.

To the bleaching solution, a halide such as ammonium bromide, potassium bromide and sodium bromide is generally added. Also, various fluorescent brighteners, defoaming agents or surfactants may be added therein.

A preferred replenishing amount of the bleaching solution is 500 ml or less, preferably 20 ml to 400 ml, most preferably 40 ml to 350 ml per 1 $m^2$ of a light-sensitive silver halide color photographic material. When the replenishing amount becomes small, the effects of the present invention become more marked.

In the present invention, in order to heighten the activity of the bleaching solution, air or oxygen may blow in the processing bath and replenishing solution storage tank, if desired, or a suitable oxidizing agent such as hydrogen peroxide, bromate and persulfate may be optionally added.

Next, as a fixing agent to be used in the fixing solution of the fixing step which is employed after the bleaching step, at least 0.2 mole/liter of a thiosulfate is used as mentioned above, and when a thiocyanate is mixedly used, the problem of fixing and adhering which are technical task of the present invention can be solved more effectively. An amount of the thiocyanate to be added is preferably in the range of 0.1 to 3.0 mole/liter, more preferably 0.2 to 2.5 mole/liter.

In the fixing solution, in addition to these fixing agents, a pH buffer comprising various salts such as boric acid, borax, sodium hydroxide, potassium hydroxide, sodium carbonate, potassium carbonate, sodium bicarbonate, potassium bicarbonate, acetic acid, sodium acetate and ammonium hydroxide may be added alone or in combination of two or more.

Further, it is desired to contain a rehalogenization agent such as an alkali halide or an ammonium halide including, for example, potassium bromide, sodium bromide, sodium chloride and ammonium bromide, with a large amount. Also, a compound which has been generally known to add to the fixing solution, such as a pH buffer including borate, oxalate, acetate, carbonate and phosphate, an alkylamine and a polyethyleneoxide may be optionally added.

Also, in the fixing solution of the present invention, it is preferred embodiment that an amount of an ammonium ion is 50 mole % or less, preferably 20 mole % or less, particularly preferably 0 to 10 mole % per total cation, since stain can be prevented when processing is carried out from the bleaching solution to the fixing solution directly and pollution can be reduced due to reduction of an ammonium ion. However, when an amount of the ammonium ion is reduced, a bad effect to fixing property may be sometimes caused. Therefore, it is preferred to combinedly use 0.1 mole/liter to 3.0 mole/liter of a thiocyanate or make the concentration of the thiosulfate 0.5 mole/liter or more, preferably 1.0 mole/liter or more, particularly preferably 1.2 mole/-liter to 2.5 mole/liter.

Silver may be recovered from the fixing solution by the conventionally known method. For example, effectively utilized methods are the electrolysis method (French Patent No. 2,299,667), the precipitation method (Japanese Provisional Patent Publication No. 73037/1977 and German Patent No. 2,331,220), the ion-exchange method (Japanese Provisional Patent Publication No. 17114/1976 and German Patent No. 2,548,237) and the metal substitution method (British Patent No. 1,353,805).

When the silver recovery is carried out by using the electrolysis method from a tank solution or using an anion exchange resin with inline, rapid processing suitability becomes better so that they are particularly preferred. However, the silver recovery may be carried out from an over-flown solution and regenerated to use.

A replenishing amount of the fixing solution is preferably 1200 ml or less per 1 $m^2$ of a light-sensitive material, more preferably 20 ml to 1000 ml, particularly preferably 50 ml to 800 ml per 1 $m^2$ of a light-sensitive material.

A pH of the fixing solution is preferably in the range of 4 to 8.

To the fixing solution, the compound represented by the formula (FA) disclosed at page 56 of Japanese Provisional Patent Publication No. 222259/1989 or exemplary compounds thereof, whereby other effect that a sludge generated during processing of a small amount of a light-sensitive material for a long period of term using a bleach-fixing solution or a fixing solution becomes extremely small can be obtained.

The compound represented by the formula (FA) disclosed in the above Patent Application can be synthesized according to the general method as disclosed in U.S. Pat. No. 3,335,161 and No. 3,260,718. These compounds represented by the formula (FA) may be used alone or in combination of two or more.

An amount of the compound represented by the formula (FA) is preferably in the range of 0.1 g to 200 g per liter of the processing solution whereby good results can be obtained.

In the fixing solution, a sulfite or a compound releasing a sulfuric acid may be used. As exemplary compounds of these, there may be mentioned potassium sulfite, sodium sulfite, ammonium sulfite, ammonium hydrogen sulfite, potassium hydrogen sulfite, sodium hydrogen sulfite, potassium metabisulfite, sodium metabisulfite and ammonium metabisulfite. Further, the compound represented by the formula [B - 1] or [B - 2] disclosed at page 60 of Japanese Patent Application No. 48931/1988 is included therein.

These sulfites and the compounds releasing sulfuric acid are required to be contained in the fixing solution with an amount of at least 0.1 mole per liter of the fixing solution, preferably in the range of 0.12 mole/liter to 0.65 mole/liter, particularly preferably in the range of 0.15 mole/liter to 0.50 mole/liter. Above all, in the range of 0.20 mole/liter to 0.40 mole/liter is particularly preferred.

Processing times by the bleaching solution and the fixing solution according to the present invention are optional, but preferably each 4 minutes 30 seconds or shorter, more preferably 20 seconds to 3 minutes and 20 seconds, particularly preferably 40 seconds to 3 minutes, above all, particularly preferably in the range of 60 seconds to 2 minutes and 40 seconds.

In the processing method of the present invention, compulsory stirring means of the bleaching solution and the fixing solution is preferably provided. The reason is not only accomplishing the effects of the present invention effectively but also suitable for rapid processing. Here, compulsory stirring means of the solutions is not usual diffusion and movement of a solution but compulsory stirring the solution by providing a stirring means. As the compulsory stirring means, those disclosed in Japanese Provisional Patent Publications No. 222259/1989 and No. 206343/1989 can be employed.

Also, in the present invention, when setting a cross-over time between each tank such as from a color developing tank to a bleaching tank or a bleach-fixing tank to within 10 seconds, preferably within 7 seconds, good effect against bleaching fog, which is other effect of the present invention, can be obtained. Further, it is a preferred embodiment for effecting the present invention to provide a duck hill valve, etc. in order to make less amount of a processing solution to be brought in by a light-sensitive material.

As a color developing agent to be used in the color developing processing step, an aminophenol type compound and a p-phenylenediamine type compound may be mentioned, but in the present invention, a p-phenylenediamine type compound having a water-soluble group is preferred.

Such a water-soluble group is possessed at least one at an amino group or on a benzene nucleus, and concrete water-soluble groups may preferably include: $-(CH_2)_n-CH_2OH$, $-(CH_2)_m-NHSO_2-(CH_2)_n-CH_3$, $-(CH_2)_m-O-(CH_2)_n-CH_3$ and $-(CH_2CH_2)_nC_mH_{2m+1}$ (where m and n each represent an integer of 0 or more), —COOH group and $-SO_3H$ group.

Specific exemplary compounds of the color developing agent to be preferably used in the present invention are enumerated below.

(Exemplary color developing agent)

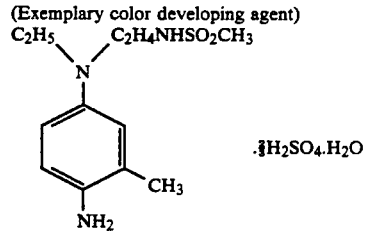

(A-1)

-continued
(A-2)
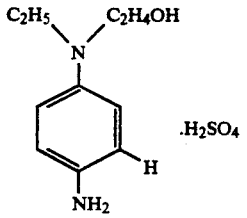
(A-3)
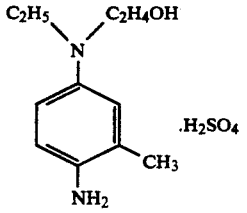
(A-4)
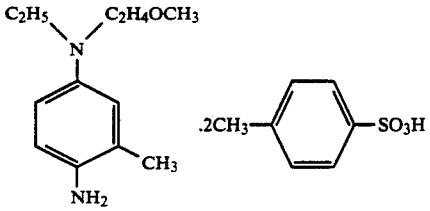
(A-5)
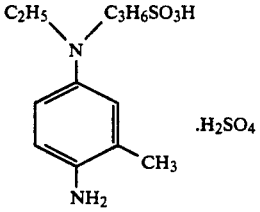
(A-6)
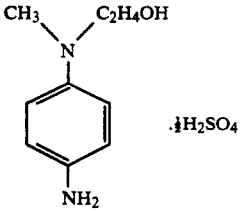
(A-7)
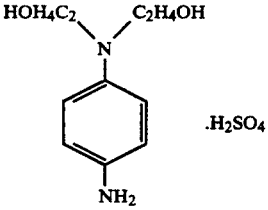
(A-8)
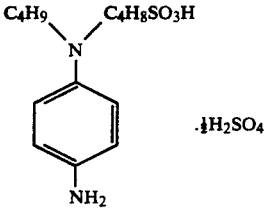
-continued
(A-9)
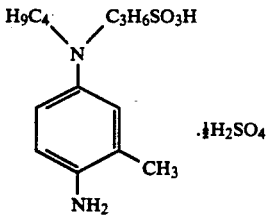
(A-10)
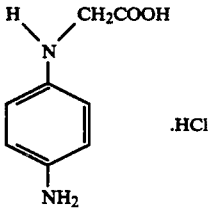
(A-11)
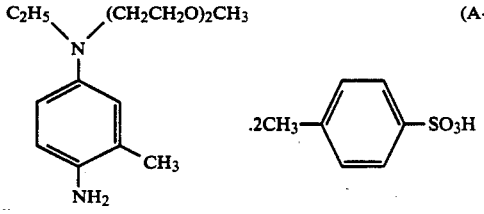
(A-12)
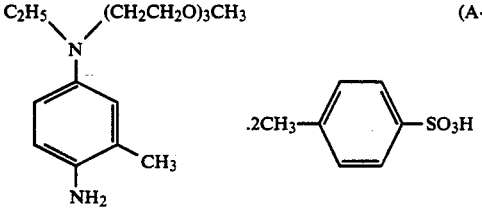
(A-13)
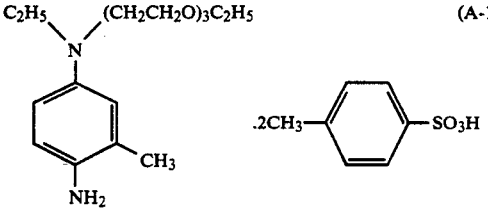
(A-14)
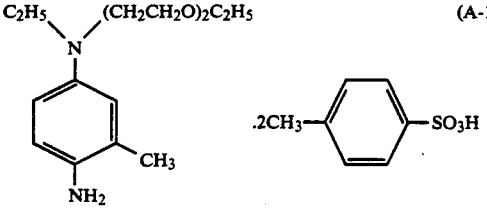
(A-15)
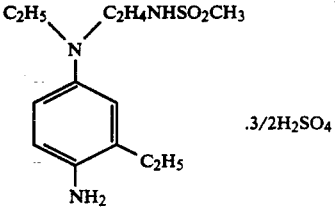

-continued

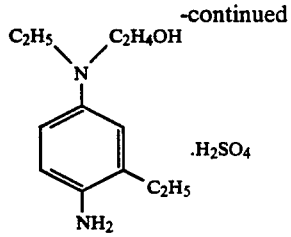

(A-16)

Of these color developing agent exemplified above, preferred in the present invention are compounds represented by Exemplary No. (A - 1), (A - 2), (A - 3), (A - 4), (A - 6), (A - 7) and (A - 15), and particularly preferred are No. (A - 1) and (A - 3).

The above color developing agent is generally used in the form of a salt such as hydrochloride, sulfate and p-toluenesulfonate.

The color developing solution to be used in the color developing processing step may contain an alkali agent to be generally used in the developing solution such as sodium hydroxide, potassium hydroxide, ammonium hydroxide, sodium carbonate, potassium carbonate, sodium sulfate, sodium metaborate or borax. Further, the solution may contain various additives including benzyl alcohol, alkali halide such as potassium bromide and potassium chloride, a development controller such as hydrazinic acid, a preservative such as hydroxylamine, a hydroxylamine derivative (e.g. diethylhydroxylamine), a hydrazine derivative (e.g. hydrazinodiacetic acid) or a sulfite Furthermore, various defoaming agents or surfactants, and organic solvents such as methanol, dimethylformamide and dimethylsulfoxide may be contained.

A pH of the color developing solution is usually 7 or higher, preferably about 9 to 13.

In the color developing solution, an antioxidant such as tetronic acid, tetronimide, 2-anilinoethanol, dihydroxyacetone, aromatic secondary alcohol, hydroxamic acid, pentose or hexose, and pyrogallol-1,3-dimethyl ether may be contained.

In the color developing solution, as a metal ion sequestering agent, various cheleting agents may be combinedly used. For example, as the cheleting agent, there may be mentioned aminopolycarboxylic acids such as ethylenediaminetetraacetic acid and diethylenetriaminepentaacetic acid, organic phosphonic acids such as 1-hydroxyethylidene-1,1-diphosphonic acid, aminopolyphosphonic acids such as aminotri(methylenephosphonic acid) or ethylenediaminetetraphosphoric acid, oxycarboxylic acids such as citric acid and gluconic acid, phosphonocarboxylic acids such as 2-phosphonobutane-1,2,4-tricarboxylic acid, polyphosphoric acids such as tripolyphosphoric acid and hexametaphosphoric acid.

A replenishing amount of the color developing solution in the continuous processing is preferably 15.0 ml or less, more preferably 2.5 ml to 9.0 ml, further preferably 3.0 ml to 7.0 ml per 100 $cm^2$ of a light-sensitive material in the case of a color negative film. Also, in the case of processing of a color paper, it is preferably 0.2 to 3.0 ml, more preferably 0.3 to 1.6 ml based on the same.

In the present invention, a light-sensitive material is further processed in washing or stabilization processing step subsequent to the fixing processing step.

In the stabilizing processing, there are a processing by a super stabilizer and a conventional type stabilizing processing using formalin. In the present specification referred to the stabilizing processing, it means the processing by a super stabilizer unless otherwise mentioned. Also, when a stabilizing solution is simply referred to, it means a processing solution used for a super stabilizer.

A replenishing amount of the stabilizing solution in the continuous processing is preferably 0.5 to 50 times of an amount brought in from the previous bath per unit area of a light-sensitive color photographic material for photographing.

An amount brought in from the previous bath may vary depending on the kind of a light-sensitive material, transporting rate of an automatic processor, a transporting system and a squeezing system at the surface of a light-sensitive material. In the case of a light-sensitive color material for photographing, an amount brought in is generally 50 $ml/m^2$ to 150 $ml/m^2$ and an effective replenishing amount to the amount brought in is in the range of 25 $ml/m^2$ to 7.5 $l/m^2$, and a replenishing amount showing remarkable effects is in the range of 200 $ml/m^2$ to 1500 $ml/m^2$.

Stabilizing tanks are preferably constituted by a plural number of tanks, and preferably 2 tanks to 6 tanks, particularly preferably 2 to 3 tanks, and most preferably 2 tanks with counter current system (a system of supplying to a post-bath and overflown from a pre-bath).

A processing temperature of the processing by the stabilizing solution is preferably 15° to 60° C., more preferably in the range of 20° to 45° C.

A pH value of the stabilizing solution is preferably in the range of pH 4.0 to 9.0 in order to improve image storability, more preferably in the range of pH 4.5 to 9.0, particularly preferably in the range of pH 5.0 to 8.5.

The stabilizing solution preferably contains a metal salt in combination with a chelating agent. Such a metal salt may include a salt of a metal such as Ba, Ca, Ce, Co, In, La, Mn, Ni, Bi, Pb, Sn, Zn, Ti, Zr, Mg, Al and Sr, and they can be supplied as an inorganic salt such as a halide, hydroxide, sulfate, carbonate, phosphate and acetate, or a water-soluble chelating agent. An amount to be used is preferably in the range of $1\times10^{-4}$ to $1\times10^{-1}$ mole, more preferably in the range Of $4\times10^{-4}$ to $2\times10^{-2}$ mole per liter of the stabilizing solution.

In the stabilizing solution, an Organic acid salt (citric acid, acetic acid, succinic acid, oxalic acid and benzoic acid), a pH controller (phosphate, borate, hydrochloride and sulfate), a surfactant and an antiseptic agent may be added. These compounds may be added in any combination with any amounts so long as they are necessary for maintaining a pH of the stabilizing bath and does not cause any bad effect to stability during storage of a color photographic printing image and occurrence of precipitation.

A mildewproofing agent or antiseptic agent to be preferably used in the stabilizing solution may be mentioned a hydroxybenzoate compound, phenol type compound, thiazole type compound, pyridine type compound, guanidine type compound, carbamate type compound, morpholin type compound, phosphonium type compound, quaternary ammonium type compound, urea type compound, isoxazole type compound, propanolamine type compound, sulfamide type compound, amino acid type compound, active halogen releasing compound and benztriazole type compound.

Of these mildewproofing agents or antiseptic agents, preferably used compound are a phenol type compound, thiazole type compound, pyridine type compound, guanidine type compound, quaternary ammonium type compound, active halogen releasing compound and benztriazole type compound. Further, particularly preferably used compounds are a phenol type compound, thiazole type compound, active halogen releasing compound and benztriazole type compound in view of storability of the solution.

An amount of the mildewproofing agent or antiseptic agent to be added to the stabilizing solution is preferably in the range of 0.001 to 50 g, more preferably in the range of 0.005 to 10 g per liter of the stabilizing solution.

In the processing of the present invention, silver recovery may be effected with respect to the stabilizing solution by the method as mentioned above. Also, the stabilizing solution may be processed with an ion exchange processing, an electrodialysis processing (see Japanese Provisional Patent Publication No. 241265/1985), a reverse osmotic processing (see Japanese Provisional Patent Publication No. 241265/1985). Also, it is preferred to use water which has been previously deionized) whereby mildewproofing property of the stabilizing solution, stability of the same and storability of a printed image can be improved. As a means for deionization processing, any means which is capable of making Ca and Mg ions of washed water after processing 5 ppm or less can be employed, but preferably, for example, a processing using an ion exchange resin or reverse osmosis membrane is used alone or in combination. The ion exchange resin or reverse osmosis membrane is disclosed in detail in Journal of Technical Disclosure, No. 87-1984.

In the present invention, a salt concentration in the stabilizing solution is preferably 1,000 ppm or less, more preferably 800 ppm or less.

A processing time of the stabilizing solution is preferably 2 minutes or shorter, more preferably 1 minute and 30 seconds or shorter, particularly preferably 1 minute or shorter in view of rapid processing.

A surfactant may be added to the stabilizing solution. As the surfactant, the compounds represented by the formulae (I) and (II) described in Japanese Unexamined Patent Publication No. 250449/1987 and water-soluble organic siloxane type compounds are particularly preferably used.

Silver halide grains to be used in the light-sensitive silver halide color photographic material (hereinafter abbreviated to as "light-sensitive material" if necessary) are any of silver chloride, silver chlorobromide, silver iodobromide and silver chloroiodobromide.

An average grain size of all silver halide emulsions in the light-sensitive material is preferably 2.0 μm or less, more preferably 0.1 to 1.2 μm.

When the silver halide emulsion contains grains having an average grain size/grain thickness value of less than 5, a grain size distribution is preferably monodispersed in the point of desilvering property.

The monodispersed silver halide emulsion refers to an emulsion in which a weight of a silver halide included within the range of ±20% of its grain size with an average grain size $\bar{r}$ as a center is 60% or more, preferably 70% or more, more preferably 80% or more of a total weight of silver halide grains.

Here, an average grain size $\bar{r}$ is defined as a grain size ri when the product of ni which is frequency of grains having a grain size of ri and $ri^3$ ($ni \times ri^3$) becomes maximum (effective number of 3 digits, a number of a minimum digit is rounded).

When a silver halide grain is spherical, the grain size mentioned here is its diameter, and when a silver halide grain has a shape other than sphere, it is a diameter obtained by converting its projected area to a circle area having the same area.

The grain size can be obtained by, for example, photographing said grain magnified at a magnification of 10,000 to 50,000 with an electron microscope, and by measuring a diameter or a projected area of the grain on the print (there should be supposed to present the number of grains to be measured being randomly 1,000 grains or more).

The highly monodispersed emulsion particularly preferred in the present invention is an emulsion having a distribution width of 20% or less, preferably 15% or less defined by the following formula:

$$\frac{\text{Standard deviation}}{\text{Average grain size}} \times 100 = \text{Distribution width (\%)}$$

The silver halide grains to be used in the present invention may be normal crystal, twin crystal or other crystals, and any ratio of [1.0.0] face to [1.1.1] face can be employed as desired. Further, a crystalline structure of the silver halide grains may be either a structure which is uniform from an inner portion to an outer portion or a layer structure in which an inner portion and an outer portion are heterogeneous (core/shell type). Further, the silver halide grains may be of the type in which a latent image is formed mainly on the grain surface or of the type in which a latent image is formed internally of the grain. Also, plane silver halide grains (see Japanese Provisional Patent Publications No. 113934/1983 and No. 47959/1986) can be used.

The silver halide grains to be used in the present invention may be those obtained by any preparation method such as an acidic method, a neutral method or an ammoniacal method.

Further, for example, there may be employed a method in which seed grains are formed by an acidic method, and grown to a predetermined size according to an ammoniacal method by which grains can be grown quickly. When the silver halide grains are grown, it is preferred to control pH and pAg in a reaction vessel, and, for example, it is preferred to add and mix successively or simultaneously silver ions and halide ions in an amount which is adjusted corresponding to a growth speed of the silver halide grains disclosed in Japanese Provisional Patent Publication No. 48521/1979.

The silver halide grains according to the present invention is preferably prepared as described above. In the present specification, a composition containing said silver halide grains is called a silver halide emulsion.

These silver halide emulsions may be chemically sensitized by using active gelatin; sulfur sensitizers such as allylthiocarbamide, thiourea and cystine; selenium sensitizers; reducing sensitizers such as stannous salt, thiourea dioxide and polyamine; noble metal sensitizers such as a gold sensitizer, specifically including potassium aurithiocyanate, potassium chloroaurate and 2-aurothio-3-methylbenzothiazolium chloride; or sensitizers of water-soluble salts such as ruthenium, palladium, platinum, rhodium and iridium, specifically including ammonium chloropalladate, potassium chloroplatinate and sodium chloropalladate (some kinds of these act as a sensitizer or a fog restrainer depending on the amount used) singly or in suitable combination (for example, combination of a gold sensitizer and a sulfur sensitizer or a combination of a gold sensitizer and a selenium sensitizer).

The silver halide emulsion according to the present invention may be chemically ripened by adding a sulfur-containing compound, and prior to the chemical ripening, during ripening or after ripening, at least one of hydroxytetrazaindenes and at least one of nitrogen-containing heterocyclic compounds having a mercapto group may be contained.

For imparting light sensitivity to various desired light-sensitive wavelength reginns, the silver halide to be used in the present invention may be optically sensitized by adding a sensitizing dye in an amount of, for example, $5\times10^{-8}$ to $3\times10^{-3}$ mole per mole of the silver halide. As the sensitizing dye, various one can be used, and the sensitizing dyes can be used singly or in combination of two or more kinds, respectively.

As a light-sensitive material to which the present invention can be applied, preferred are those in which a coupler, namely a compound capable of forming a dye through reaction with an oxidized product of a color developing agent is contained in a red-sensitive silver halide emulsion layer, a blue-sensitive silver halide emulsion layer and a green-sensitive silver halide emulsion layer, respectively.

As a yellow coupler which can be used effectively, there may be included closed ketomethylene compounds and further so-called 2-equivalent couplers such as an active point-o-aryl substituted coupler, an active point-o-acyl substituted coupler, an active point hydantoin compound substituted coupler, an active point urazol compound substituted coupler, an active point succinimide compound substituted coupler, an active point fluorine substituted coupler, an active point chlorine or bromine substituted coupler and an active point-o-sulfonyl substituted coupler. Specific examples of the yellow coupler which can be used include those disclosed in U.S. Pat. No. 2,875,057, No. 3,265,506, No. 3,408,194, No. 3,551,155, No. 3,582,322, No. 3,725,072, No. 3,891,445, No. 3,933,501, No. 4,022,620, No. 4,326,024 and No. 4,401,752, West German Patent No. 1,547,868, West German Patent Publications (OLS) No. 2,219,917, No. 2,261,361 and No. 2,414,006, U.K. Patents No. 1,425,020 and No. 1,476,760, Japanese Patent Publication No. 10783/1976, Japanese Provisional Patent Publications No. 26133/1972, No. 73147/1973, No. 102636/1976, No. 6341/1975, No. 123342/1975, No. 130442/1975, No. 21827/1976, No. 876509/1975, No. 82424/1977, No. 115219/1977, No. 95346/1983 and No. 180542/1989.

When the light-sensitive color photographic material is a light-sensitive material for negative image, preferred yellow coupler may include a benzoylacetanilide type yellow coupler.

The benzoylacetanilide type yellow coupler may include any type of benzoylacetanilide derivatives, but preferred is the compound represented by the following formula (YB - 1).

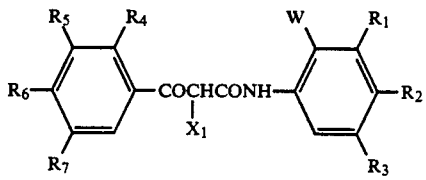

(YB-1)

In the formula, $R_1$ to $R_7$ and W each represent a hydrogen atom or a substituent, and preferably $R_1$, $R_2$ and $R_3$ may be the same or different and each represent a hydrogen atom, a halogen atom, an alkyl group, an aryl group, an alkoxy group, an acylamino group, a carbamoyl group, an alkoxycarbonyl group, a sulfonamide group or a sulfamoyl group.

$R_4$, $R_5$, $R_6$ and $R_7$ may be the same or different and preferably each represent a hydrogen atom, an alkyl group, an alkoxy group, an aryloxy group, an acylamino group or a sulfonamide group.

W represents preferably a halogen atom, an alkyl group, an alkoxy group, an aryloxy group or a dialkylamino group.

$X_1$ represents a hydrogen atom or an eliminatable group.

These benzoylacetanilide type yellow coupler may include those disclosed in U.S. Pat. No. 2,875,057, No. 3,725,072 and No. 3,891,445, Japanese Patent Publication No. 10783/1976, Japanese Provisional Patent Publications No. 73147/1973, No. 6341/1975, No. 102636/1976, No. 115219/1977, No. 21448/1979, No. 95237/1981, No. 159163/1984, No. 174838/1984, No. 206835/1984, No. 187560/1989, No. 207748/1989, No. 207748/1989, No. 207748/1989, No. 207748/1989, No. 214848/1989, No. 227152/1989, No. 231050/1989, No. 295256/1989, No. 309057/1989, No. 341240/1989 and No. 316745/1989.

A total amount of the yellow coupler to be added is generally $1.0\times10^{-3}$ mole to 1.0 mole, more preferably in the range of $5.0\times10^{-3}$ mole to $8.0\times10^{-1}$ mole per mole of silver halide.

On the other hand, the light-sensitive color photographic material is a light-sensitive photographic material for positive image, preferred yellow coupler may include the compound represented by the following formula (Y - 1).

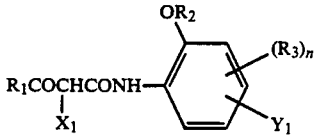

In the formula, $R_1$ represents an alkyl group, a cycloalkyl group or an aryl group, $R_2$ represents an alkyl group, a cycloalkyl group, an aryl group or an acyl group, $R_3$ represents a group which is capable of substituting on a benzene ring. n is 0 or 1. $X_1$ represents an eliminatable group through the coupling with an oxidized product of a developing agent and $Y_1$ represents an organic group.

The yellow coupler represented by the above formula (Y - 1) to be used in the present invention can be used in an amount of $1\times10^{-3}$ mole to 1 mole, more preferably in the range of $1\times10^{-2}$ mole to $8\times10^{-1}$ mole per mole of silver halide.

The magenta coupler which can be used includes pyrazolone type, pyrazolotriazole type, pyrazolinobenzimidazole type and indazolone type compounds. These magenta couplers may be not only 4-equivalent type couplers but also 2-equivalent couplers similarly as in the case of the yellow coupler. Specific examples of the magenta coupler which can be used include those disclosed in U.S. Pat. No. 2,600,788, No. 2,983,608, No. 3,062,653, No. 3,127,269, No. 3,311,476, No. 3,419,391, No. 3,519,429, No. 3,558,319, No. 3,582,322, No.

3,615,506, No. 3,834,908, No. 3,891,445, No. 4,310,619, No. 4,351,897, No. 4,500,630 and No. 4,540,654, West German Patent No. 1,810,464, West German Patent Publications (OLS) No. 2,408,665, No. 2,417,945 and No. 2,424,467, Japanese Patent Publication No. 6031/1965, Japanese Provisional Patent Publications No. 20826/1976, No. 58922/1977, No. 129538/1974, No. 74027/1974, No. 159336/1975, No. 42121/1977, No. 74028/1974, No. 60233/1975, No. 26541/1976, No. 55122/1978 and No. 43659/1985, and European Patent No. 73,636.

The magenta coupler to be preferably used may include the magenta coupler represented by the following formula (M - 1).

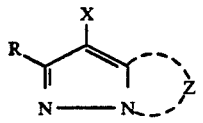

(M-1)

In the formula (M - 1), Z represents non-metallic atom group necessary for forming a nitrogen-containing heterocyclic ring, and the ring formed by the Z may have a substituent(s).

X represents a hydrogen atom or an eliminatable group through the reaction with an oxidized product of a color developing agent.

Also, R represents a hydrogen atom or a substituent.

The magenta coupler represented by the formula (M - 1) is described at page 26 of Japanese Provisional Patent Publication No. 106655/1988 and specific exemplary compounds are mentioned No. 1 to No. 77 at pages 29 to 34 of the specification.

The above magenta coupler can be used in an amount of $1\times10^{-3}$ mole to 1 mole, more preferably in the range of $1\times10^{-2}$ mole to $8\times10^{-1}$ mole per mole of silver halide. The cyan coupler which can be used includes, for example, phenol type and naphthol type couplers. These cyan couplers may be not only 4-equivalent type couplers but also 2-equivalent couplers similarly as in the case of the yellow coupler. Specific examples of the cyan coupler which can be used include those disclosed in U.S. Pat. No. 2,369,929, No. 2,434,272, No. 2,474,293, No. 2,521,908, No. 2,895,826, No. 3,034,892, No. 3,311,476, No. 3,458,315, No. 3,476,563, No. 3,583,971, No. 3,591,383, No. 3,767,411, No. 3,772,002, No. 3,933,494, No. 4,004,929, No. 4,052,212, No. 4,146,396, No. 4,228,233, No. 4,296,200, No. 4,334,001, No. 4,327,173, No. 4,451,559 and No. 4,427,767, EP-A-0 121 365 and EP-A-0 161 626, West German Patent Publications (OLS) No. 2,414,830 and No. 2,454,329, and Japanese Provisional Patent Publications No. 5983/1973, No. 26034/1976, No. 5055/1973, No. 146827/1976, No. 69624/1977, No. 90932/1977 and No. 95346/1983, and Japanese Patent Publication No. 11572/1974.

When the light-sensitive color photographic material is a light-sensitive material for negative image, preferred cyan coupler may include the compounds represented by the following formulae (C - A), (C - B) and (C - C).

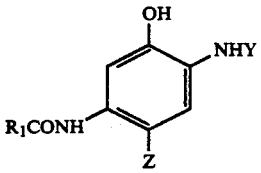

(C-A)

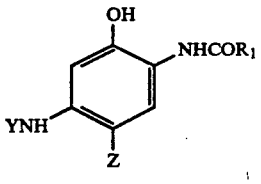

(C-B)

In the formulae, $R_1$ represents an alkyl group, an alkenyl group, a cycloalkyl group, an aryl group or a heterocyclic group, Y represents a group represented by:

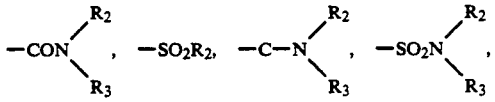

$-CONHCOR_2$ or $-CONHSO_2R_2$ (where $R_2$ represents an alkyl group, an alkenyl group, a cycloalkyl group, an aryl group or a heterocyclic group, and $R_3$ represents a hydrogen atom or a group represented by $R_2$, and $R_2$ and $R_3$ may be the same or different or may form a hetero ring having 5 to 6-membered by combining with each other), Z represents a hydrogen atom or an eliminatable group through the coupling reaction with an oxidized product of an aromatic primary amine type color developing agent.

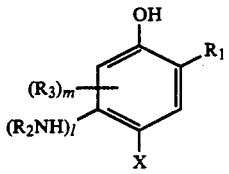

(C-C)

In the formula, $R_1$ represents $-CONR_4R_5$, $-NHCOR_4$, $-NHCOOR_6$, $-NHSO_2R_6$, $-NHCONR_4R_5$ or $-NHSO_2NR_4R_5$, $R_2$ represents a monovalent group, $R_3$ represents a substituent, X represents a hydrogen atom or an eliminatable group through the coupling reaction with an oxidized product of an aromatic primary amine type color developing agent, l is 0 or 1, m is an integer of 0 to 3, $R_4$ and $R_5$ each represent a hydrogen atom, an aromatic group, an aliphatic group or a heterocyclic group, and $R_6$ represents an aromatic group, an aliphatic group or a heterocyclic group. When m is 2 or 3, each $R_3$ may be the same or different from each other, or may form a ring by bonding to each other, and $R_4$ and $R_5$, $R_2$ and $R_3$, and $R_2$ and X may form a ring by bonding to each other. Provided that l is 0, m is 0 and $R_1$ is $-CONHR_7$, and $R_7$ represents an aromatic group.

Specific examples thereof are described in U.S. Pat. No. 3,741,563, Japanese Provisional Patent Publication No. 37425/1972, Japanese Patent Publication No. 36894/1973, Japanese Provisional Patent Publications No. 10135/1975, No. 117422/1975, No. 130441/1975, No. 108841/1976, No. 120334/1975, No. 18315/1977, No. 105226/1978, No. 14736/1979, No. 48237/1979, No. 32071/1980, No. 65957/1980, No. 1938/1981, No 12643/1981, No. 27147/1981, No. 146050/1984, No. 166956/1984, No. 24547/1985, No. 35731/1985 and No. 37557/1985.

Examples of the coupler represented by the formula (C - C) are described in Japanese Provisional Patent Publications No. 237448/1985, No. 153640/1986, No. 145557/1986, No. 85242/1987, No. 15529/1973, No. 117422/1975, No. 18315/1977, No. 90932/1977, No. 52423/1978, No. 48237/1979, No. 66129/1979, No. 32071/1980, No. 65957/1980, No. 105226/1980, No. 1938/1981, No. 12643/1981, No. 27147/1981, No. 126832/1981 and No. 95346/1983, and U.S. Pat. No. 3,488,193, and these compounds can be synthesized the methods disclosed therein.

The above cyan coupler can be used in an amount of $1\times10^{-3}$ mole to 1 mole, more preferably in the range of $5.0\times10^{-3}$ mole to $8\times10^{-1}$ mole per mole of silver halide.

Next, when the light-sensitive color photographic material is a light-sensitive material for positive image, preferred cyan coupler may include the following compound represented by the formula (C - 1).

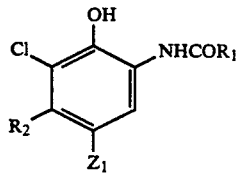

(C-1)

In the above formula, $R_1$ represents a ballast group, $R_2$ represents an alkyl group having 2 or more carbon atoms, and $Z_1$ represents a hydrogen atom or an eliminatable atom or group through the reaction with an oxidized product of a color developing agent.

Specific examples are described in Japanese Patent Publication No. 11572/1974, and Japanese Provisional Patent Publications No. 3142/1986, No. 9652/1986, No. 9653/1986, No. 39045/1986, No. 50136/1986, No. 99141/1986 and No. 105545/1986.

The above cyan forming coupler represented by the formula (C - 1) can be used generally in an amount of $1\times10^{-3}$ mole to 1 mole, more preferably in the range of $1.0\times10^{-2}$ mole to $8\times10^{-1}$ mole per mole of silver halide.

As the cyan coupler, the coupler represented by the formula (C - 1) and 2,5-diacylamino type cyan coupler are preferably used in combination.

As the 2,5-diacylamino type cyan coupler, the following compound represented by the formula (C - 2) can be mentioned.

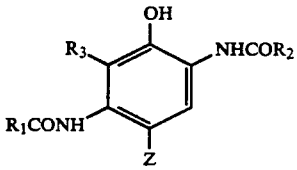

(C-2)

In the formula, $R_1$ represents an alkyl group or an aryl group, $R_2$ represents an alkyl group, a cycloalkyl group, an aryl group or a heterocyclic group, $R_3$ represents a hydrogen atom, a halogen atom, an alkyl group or an alkoxy group, and $R_3$ may form a ring with $R_1$, and Z represents a hydrogen atom or aneliminatable atom or group through the coupling reaction with an aromatic primary amine type color developing agent.

Specific examples of the above cyan coupler may further include 2,5-diacylamino type cyan couplers disclosed in Japanese Provisional Patent Publication No. 178962/1987 (pages 26 to 35), Japanese Provisional Patent Publications No. 225155/1985 (page 7, left bottom column to page 10 right bottom column), No. 222853/1985 (page 6, left upper column to page 8, right bottom column) and No. 185335/1984 (page 6, left bottom column to page 9, left upper column) and they can be synthesized by the methods disclosed in these publications.

The above cyan forming coupler represented by the formula (C - 2) can be used generally in an amount of $1\times10^{-3}$ mole to 1 mole, more preferably in the range of $1.0\times10^{-2}$ mole to $8\times10^{-1}$ mole per mole Of silver halide.

When the cyan coupler represented by the above formula (C - 1) and the cyan coupler represented by the formula (C - 2) are used in combination, a mixing ratio is preferably 1:9 to 9:1, particularly preferably 7:3 to 3:7 in terms of molar ratio.

In the silver halide emulsion layer and other photographic constituent layers, couplers such as a colored magenta or colored cyan coupler and a polymer coupler can be used in combination. As to the colored magenta or colored cyan coupler, reference can be made to Japanese Provisional Patent Publication No. 72235/1986 by the present applicant(s), and as to the polymer coupler, reference can be made to Japanese Provisional Patent Publication No. 50143/986 by the present applicant(s), respectively.

Further, it is a preferred embodiment of the present invention to use BAR compounds (exemplary compounds (1) to (77)) described on pp. 232 to 278 of Japanese Patent Application No. 32501/1988, which are effective on the effect of the present invention, particularly rapid processing and desilvering property.

In the present invention, when a light-sensitive material with high silver chloride content is used, it is preferred to use nitrogen-containing heterocyclic mercapto compounds in combination.

Specific examples of the nitrogen-containing heterocyclic mercapto compounds include (I'-1) to (I'-87) described on pp. 42 to 45 of Japanese Provisional Patent Publication No. 106655/1988.

In the light-sensitive silver halide color photographic material to be used in the present invention, various additives for photography can be contained. For example, antifoggants, stabilizers, UV absorbers, color antistaining agents, fluorescent brighteners, color image anti-fading agents, antistatic agents, hardeners, surfactants, plasticizers and humectants disclosed in Research Disclosure No. 17643 can be employed.

In the light-sensitive material, as a hydrophilic colloid used for preparing an emulsion, gelatin is preferred, and there is included, other than gelatin, any desired one of gelatin derivatives, graft polymers of gelatin and other polymers, proteins such as albumin and casein, cellulose derivatives such as hydroxyethyl cellulose derivatives and carboxymethyl cellulose, starch derivatives and synthetic hydrophilic polymers of homopolymers or copolymers such as polyvinyl alcohol, polyvinylimidazole and polyacrylamide.

As a support of the light-sensitive material, there may be mentioned a baryta paper or a polyethylene-coated paper, a polypropylene synthetic paper, a transparent support used in combination with a reflective layer, for example, a glass plate, polyester films such as cellulose acetate, cellulose nitrate or polyethylene terephthalate, a polyamide film, a polycarbonate film and a polystyrene film, and also other transparent supports used in general. A support to be used is selected suitably therefrom depending on the use of the light-sensitive material.

For providing the silver halide emulsion layer to be used in the present invention and other photographic constituent layers by coating, various coating methods such as a dipping coating method, an air doctor coating method, a curtain coating method and a hopper coating method can be employed. Also, a simultaneous coating method of two or more layers disclosed in U.S. Pat. No. 2,761,791 and No. 2,941,898 can be employed.

Coating positions of the respective emulsion layers can be determined as desired. For example, in the case of a light-sensitive material for printing paper of full color, it is preferred to arrange a blue-sensitive silver halide emulsion layer, a green-sensitive silver halide emulsion layer and a red-sensitive silver halide emulsion layer in this order from a support. These light-sensitive silver halide emulsion layers may be constituted of two or more layers, respectively.

In the light-sensitive material to be processed in the present invention, an intermediate layer with an appropriate thickness can be provided as desired depending on the purpose. Further, various layers such as a filter layer, a non-non-curling layer, a protective layer and an antihalation layer can be used in combination suitably as a constituent layer. In these constituent layers, the hydrophilic colloids which can be used in the emulsion layer as described above can be used similarly as a bonding agent. Also, in the layers, various additives for photography which can be contained in the emulsion layer as described above can be contained.

The processing method of a light-sensitive material of the present invention can be applied to any desired light-sensitive silver halide color photographic material such as a color paper, a color negative film, a color positive film, a color reversal film for slide, a color reversal film for movie, a color reversal film for television and a reversal color paper provided that the light-sensitive silver halide color photographic material is a light-sensitive material which contains a coupler therein and is processed by the so-called internal development system. Above all, a light-sensitive silver halide color photographic material for photographing is particularly preferred.

According to the present invention, a processing solution for a light-sensitive material which can prevent occurrence of deposit in the fixing solution and occurrence of frictional drag and jamming, and a processing method using the same can be provided.

EXAMPLES

In the following, the present invention will be described in more detail by referring to Examples, but the present invention is not limited by these Examples at all.

EXAMPLE 1

A fixing solution shown below was prepared.

| | |
|---|---|
| Ammonium thiosulfate | 1.2 mole |
| Ammonium sulfite | 15 g |

-continued

| | |
|---|---|
| Sodium metabisulfite | 1.0 g |
| Sodium nitrate | 30 g |
| Water-soluble surfactant (shown in Table 1) | 0.35 g |
| Adjusted to pH 7.20 and made up to 1 liter. | |

0.1 ml of the above fixing solution was dropped on a rein plate made of polyvinyl chloride. These plates were stored under the conditions of 50° C. and a humidity of 50% for 10 days. Then, the surface thereof was wiped off with a paper towel moistened with water and a fixing and adhering state of the surface was observed.

The evaluation standard is based on the following method.

◎ No fixing and adhering nor quality change on the surface

○ Fixing and adhering are slightly present on the surface but peel off when rubbed strongly.

Δ Fixing and adhering are significantly present on the surface but peel off when rubbed strongly.

X Fixing and adhering are present on the surface and peel off slightly when rubbed strongly.

XX Fixing and adhering are present on the surface and do not peel off even when rubbed strongly.

The results are shown in Table 1.

TABLE 1

| Fixing solution No. | Water-soluble surfactant | Fixing and adhering state |
|---|---|---|
| 1 - 1 | — | XX |
| 1 - 2 | I - 5 | ◎ |
| 1 - 3 | I - 16 | ◎ |
| 1 - 4 | I - 22 | ◎ |
| 1 - 5 | I - 24 | ◎ |
| 1 - 6 | I - 27 | ◎ |
| 1 - 7 | I - 32 | ◎ |
| 1 - 8 | I - 33 | ◎ |
| 1 - 9 | I - 34 | ◎ |
| 1 - 10 | I - 36 | ◎ |
| 1 - 11 | I - 37 | ◎ |
| 1 - 12 | I - 54 | ◎ |
| 1 - 13 | I - 59 | ◎ |
| 1 - 14 | I - 72 | ◎ |
| 1 - 15 | II - 2 | ○ |
| 1 - 16 | II - 4 | ○ |
| 1 - 17 | III - 5 | ○ |
| 1 - 18 | IV - 6 | ○ |
| 1 - 19 | V - 1 | ◎ |
| 1 - 20 | V - 3 | ◎ |
| 1 - 21 | VI - 1 | Δ |
| 1 - 22 | VI - 5 | Δ |
| 1 - 23 | VII - 1 | Δ |
| 1 - 24 | VIII - 1 | Δ |
| 1 - 25 | VIII - 4 | Δ |
| 1 - 26 | VIII - 24 | Δ |
| 1 - 27 | IX - 1 | ○ |
| 1 - 28 | IX - 12 | ○ |
| 1 - 29 | X - 1 | ○ |
| 1 - 30 | XI - 1 | ○ |
| 1 - 31 | XI - 4 | ○ |

As seen from Example 1, when the water-soluble surfactant of the present invention, particularly the water-soluble surfactants represented by the formulae (I) or (V) are employed, fixing and adhering property can be improved.

EXAMPLE 2

By using the water-soluble surfactants I - 2, 3, 8, 14, 20, 25, 41, 49, 56, 63, 71, 78, IV - 2, 4, 10, V - 2, 4, 8, IX - 3, 13, 14, X - 2 and XI - 2, 6 and 9 which are other than those used in Example 1, the same experiment was carried out. As the results, substantially the same effects as in Example 1 could be obtained.

EXAMPLE 3

The same evaluation as in Example 1 was carried out except for changing an amount of ammonium thiosulfate in the fixing solution used in Example 1 and changing the water-soluble surfactant to those shown in Table 2.

The results are shown in Table 2.

TABLE 2

| Fixing solution No. | Ammonium thiosulfate | Water-soluble surfactant | Fixing and adhering state |
|---|---|---|---|
| 2 - 1 | — | — | ◎ |
| 2 - 2 | 0.1 mole | — | ○ |
| 2 - 3 | " | I - 5 | ◎ |
| 2 - 4 | " | I - 37 | ◎ |
| 2 - 5 | " | V - 3 | ◎ |
| 2 - 6 | " | IX - 1 | ◎ |
| 2 - 7 | " | XI - 1 | ◎ |
| 2 - 8 | 0.2 mole | — | Δ |
| 2 - 9 | " | I - 5 | ◎ |
| 2 - 10 | " | I - 37 | ◎ |
| 2 - 11 | " | V - 3 | ◎ |
| 2 - 12 | " | IX - 1 | ◎ |
| 2 - 13 | " | XI - 1 | ◎ |
| 2 - 14 | 0.5 mole | — | X |
| 2 - 15 | " | I - 5 | ◎ |
| 2 - 16 | " | I - 37 | ◎ |
| 2 - 17 | " | V - 3 | ◎ |
| 2 - 18 | " | IX - 1 | ◎ |
| 2 - 19 | " | XI - 1 | ◎ |
| 2 - 20 | 0.8 mole | — | XX |
| 2 - 21 | " | I - 5 | ◎ |
| 2 - 22 | " | I - 37 | ◎ |
| 2 - 23 | " | V - 3 | ◎ |
| 2 - 24 | " | IX - 1 | ○ |
| 2 - 25 | " | XI - 1 | ○ |
| 2 - 26 | 1.2 mole | — | XX |
| 2 - 27 | " | I - 5 | ◎ |
| 2 - 28 | " | I - 37 | ◎ |
| 2 - 29 | " | V - 3 | ◎ |
| 2 - 30 | " | IX - 1 | ○ |
| 2 - 31 | " | XI - 1 | ○ |

As clearly seen from Table 2, it can be understood that while the fixing and adhering state became bad when an amount of ammonium thiocyanate had been 0.2 mole or more, it could be improved by adding the water-soluble surfactant of the present invention. Further, an amount of ammonium thiosulfate is 0.5 mole or more, fixing and adhering are less caused in the sample of the present invention.

EXAMPLE 4

The following fixing solution was prepared.

| | |
|---|---|
| Ammonium thiosulfate | 1.2 mole |
| Ammonium sulfite | 15 g |
| Sodium metabisulfite | 1.0 g |
| Sodium nitrate | 30 g |
| Water-soluble surfactant (shown in Table 3) | 0.25 g |
| Organic acid ferric complex salt (shown in Table 3) | |
| Adjusted to pH 7.20 and made up to 1 liter. | |

The above fixing solution was evaluated in the same manner as in Example 1. Provided that a polystyrene type resin was used as a resin and the stored term was made 2 weeks.

The results are shown in Table 3.

TABLE 3

| Fixing solution No. | Organic acid ferric complex salt | | Water-soluble surfactant | Fixing and adhering state |
|---|---|---|---|---|
| 3 - 1 | EDTAFe(III) | — | — | XX |
| 3 - 2 | " | $5 \times 10^{-2}$ mole | — | X |
| 3 - 3 | " | $1.0 \times 10^{-1}$ mole | — | Δ |
| 3 - 4 | " | $2.0 \times 10^{-1}$ mole | — | ○ |
| 3 - 5 | " | $5 \times 10^{-2}$ mole | V - 3 | ◎ |
| 3 - 6 | " | $1.0 \times 10^{-1}$ mole | " | ◎ |
| 3 - 7 | " | $2.0 \times 10^{-1}$ mole | " | ◎ |
| 3 - 8 | PDTAFe(III) | $5 \times 10^{-2}$ mole | — | Δ |
| 3 - 9 | " | $1.0 \times 10^{-1}$ mole | — | ○ |
| 3 - 10 | " | $2.0 \times 10^{-1}$ mole | — | ○ |
| 3 - 11 | " | $5 \times 10^{-2}$ mole | V - 3 | ◎ |
| 3 - 12 | " | $1.0 \times 10^{-1}$ mole | " | ◎ |
| 3 - 13 | " | $2.0 \times 10^{-1}$ mole | " | ◎ |
| 3 - 14 | DIPAFe(III) | $5 \times 10^{-2}$ mole | — | X |
| 3 - 15 | " | $1.0 \times 10^{-1}$ mole | — | Δ |
| 3 - 16 | " | $2.0 \times 10^{-1}$ mole | — | ○ |
| 3 - 17 | " | $5 \times 10^{-2}$ mole | V - 3 | ◎ |
| 3 - 18 | " | $1.0 \times 10^{-1}$ mole | " | ◎ |
| 3 - 19 | " | $2.0 \times 10^{-1}$ mole | " | ◎ |

EDTAFe(III): Ammonium ferric ethylenediaminetetra-acetate
PDTAFe(III): Ammonium ferric 1,3-diaminopropane-diaminetetraacetate
DTPAFe(III): Ammonium ferric diethylenetriaminepenta-acetate As clearly seen from Table 3, it can be understood that inhibiting effect could be admitted when organic acid ferric complex salt had been added even when the water-soluble surfactant had not been present, but fixing and adhering preventive effect of the water-soluble surfactant according to the present invention could be developed when an amount of the organic acid ferric complex salt was $5 \times 10^{-2}$ mole/liter or less.

EXAMPLE 5

In Example 4, the same experiment was carried out by using the water-soluble surfactants used in Example 1. As the results, substantially the same effects as in Example 4 can be obtained.

EXAMPLE 6

In Example 4, the same experiment was carried out except for changing the water-soluble surfactant to V - 8 and using a thiocyanate instead of the organic acid ferric complex salt with an amount shown in Table 4 to evaluate the samples.

The results are shown in Table 4.

TABLE 4

| Fixing solution No. | Thiocyanate (mole/liter) | Water-soluble surfactant | Fixing and adhering state |
|---|---|---|---|
| 4 - 1 | — | None | XX |
| 4 - 2 | 0.05 | " | XX |
| 4 - 3 | 0.1 | " | XX |
| 4 - 4 | 0.2 | " | X |
| 4 - 5 | 0.5 | " | Δ |
| 4 - 6 | 2.0 | " | ○ |
| 4 - 7 | — | V - 8 | ○ |
| 4 - 8 | 0.05 | " | ○ |
| 4 - 9 | 0.1 | " | ◎ |
| 4 - 10 | 0.2 | " | ◎ |
| 4 - 11 | 0.5 | " | ◎ |
| 4 - 12 | 2.0 | " | ◎ |

As clearly seen from Table 4, improvement in preventing fixing and adhering can be admitted by adding 0.1 mole/1 or more of thiocyanate (ammonium thiocyanate).

Also, the same evaluation was carried out by using water-soluble surfactants (activators) other than V - 8 used in Examples 1 and 2, the substantially the same results as in Table 4 can be obtained.

EXAMPLE 7

After photographing color negative films of KONICA GX-II 100 (trade name, produced by KONICA CORPORATION), GOLD 100 (trade name, produced by Eastman Kodak) and SUPER HR-II 100 (trade name, produced by Fuji Photo Film Co.), respectively, processing was carried out 20 films (24 sheets photographing) per day for 3 months by using an automatic processor KP-40 (trade name, produced by KONICA CORPORATION) with a ratio of each 2:1:2

Processing conditions and compositions of the processing solutions are as shown below.

| Processing steps | <Processing conditions> Processing time | Processing temp. (°C.) | Replenishing amount (ml/m²) |
|---|---|---|---|
| Color developing | 3 min 15 sec | 38 ± 0.3 | 1480 |
| Bleaching | 3 min 15 sec | 25 to 38 | 270 |
| Fixing | 3 min 15 sec | 20 to 38 | 926 |
| *Super stabilizer | 1 min 40 sec | 20 to 38 | 926 |
| Stabilizing (Conventional type) | 45 sec | 20 to 38 | 926 |
| Drying | 2 min 5 sec | 45 to 60 | |

*Super stabilizer is two tank counter-current system. An amount brought in by a light-sensitive material is 50 ml/m².

Color developing solution

| | |
|---|---|
| Potassium carbonate | 30 g |
| Potassium hydrogen carbonate | 2.7 g |
| Potassium iodide | 1.2 mg |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxyethyl)aniline sulfate | 4.6 g |
| Diethylenetriaminepentaacetic acid | 3.0 g |
| Potassium hydroxide | 1.3 g |
| Made up to 1 liter in total with addition of water, and adjusted to pH to 10.01 with potassium hydroxide or 20% sulfuric acid. | |

Color developing replenishing solution

| | |
|---|---|
| Potassium carbonate | 40 g |
| Potassium hydrogen carbonate | 3 g |
| Potassium sulfite | 7 g |
| Sodium bromide | 0.9 g |
| Hydroxylamine sulfate | 3.2 g |
| 4-Amino-3-methyl-N-ethyl-N-(β-hydroxyethyl)aniline sulfate | 6.0 g |
| Diethylenetriaminepentaacetic acid | 3.0 g |

-continued

| | |
|---|---|
| Potassium hydroxide | 2 g |
| Made up to 1 liter in total with addition of water, and adjusted to pH to 10.12 with potassium hydroxide or 20% sulfuric acid. | |

Bleaching solution and bleaching replenishing solution

| | |
|---|---|
| Ammonium ferric ethylenediaminetetraacetate | 0.25 mole |
| Disodium ethylenediaminetetraacetate | 2 g |
| Ammonium bromide | 120 g |
| Glacial acetic acid | 40 ml |
| Ammonium nitrate | 40 g |
| 3-Mercapto-1,2,4-triazole | 0.5 g |
| Made up to 1 liter in total with addition of water and adjusted to pH to 5.8 with aqueous ammonia or glacial acetic acid. | |

Fixing solution and fixing replenishing solution

| | |
|---|---|
| Ammonium thiosulfate | 200 g |
| Anhydrous sodium bisulfite | 20 g |
| Sodium metabisulfite | 4.0 g |
| Disodium ethylenediaminetetraacetate | 1.0 g |
| Made up to 1 liter in total with addition of water and adjusted to pH to 6.5 with glacial acetic acid and aqueous ammonia. | |

Superstabilizer and replenishing solution of the same

| | |
|---|---|
| 5-Chloro-2-methyl-4-isothiazolin-3-one | 0.05 g |
| 2-Methyl-4-isothiazolin-3-one | 0.02 g |

Stabilizing solution and replenishing solution of the same

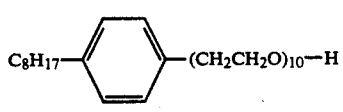

0.5 g

| | |
|---|---|
| Formaldehyde (37% aqueous solution) | 3.0 ml |

After processing, fixing and adhering state of a rack of the fixing bath was observed and the same evaluation as in Example 4 was carried out.

The results are shown in Table 5.

TABLE 5

| Processing solution No. | Water-soluble surfactant | Fixing and adhering state |
|---|---|---|
| 5 - 1 | — | XX |
| 5 - 2 | I - 5 | ○ |
| 5 - 3 | I - 34 | ○ |
| 5 - 4 | I - 37 | ○ |
| 5 - 5 | V - 3 | ◎ |
| 5 - 6 | V - 8 | ◎ |

As clearly seen from Table 5, it can be understood that fixing and adhering can be prevented in the actual running processing by adding the water-soluble surfactant of the present invention.

EXAMPLE 8

By using light-sensitive materials used in Example 7, processing was carried out under the following conditions and processing solutions shown below and the same evaluation was carried out as in Example 7.

Processing conditions

| Processing steps | Processing time | Processing temp. (°C.) | Replenishing amount (ml/m²) |
|---|---|---|---|
| Color developing | 3 min 15 sec | 38° C. | 570 |
| Bleaching | 45 sec | 38° C. | 155 |
| Fixing | 1 min 45 sec | 38° C. | 500 |
| Super stabilizer | 90 sec | 38° C. | 775 |
| Drying | 1 min | 40 to 70° C. | — |

(Replenishing amount is a value per 1 m² of a light-

-continued

| Processing conditions | | | |
|---|---|---|---|
| Processing steps | Processing time | Processing temp. (°C.) | Replenishing amount (ml/m²) |
| sensitive material) | | | |

Super stabilizer was carried out with three tanks counter-current system and replenishing solution was replenished at the final tank and overflow flows in the previous tank.

| | |
|---|---|
| Color developing solution | |
| Potassium carbonate | 30 g |
| Potassium hydrogen carbonate | 2.7 g |
| Potassium iodide | 1.2 mg |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxyethyl)aniline sulfate | 4.6 g |
| Diethylenetriaminepentaacetic acid | 3.0 g |
| Potassium hydroxide | 1.3 g |
| Made up to 1 liter in total with addition of water, and adjusted to pH to 10.01 with potassium hydroxide or 20% sulfuric acid. | |
| Color developing replenishing solution | |
| Potassium carbonate | 40 g |
| Potassium hydrogen carbonate | 3 g |
| Potassium sulfite | 7 g |
| Sodium bromide | 0.5 g |
| Hydroxylamine sulfate | 3.2 g |
| 4-Amino-3-methyl-N-ethyl-N-(β-hydroxyethyl)aniline sulfate | 6.0 g |
| Diethylenetriaminepentaacetic acid | 3.0 g |
| Potassium hydroxide | 2 g |
| Made up to 1 liter in total with addition of water, and adjusted to pH to 10.12 with potassium hydroxide or 20% sulfuric acid. | |
| Bleaching solution | |
| Ammonium ferric 1,3-diaminopropanetetraacetate | 0.35 mole |
| Ammonium bromide | 150 g |
| Glacial acetic acid | 40 ml |
| Ammonium nitrate | 40 g |
| Ammonium 1,3-diaminopropanetetraacetate | 2.0 g |
| Made up to 1 liter in total with addition of water and adjusted to pH to 4.5 with aqueous ammonia or glacial acetic acid. | |
| Bleaching replenishing solution | |
| Ammonium ferric 1,3-diaminopropanetetraacetate | 0.40 mole |
| Disodium ethylenediaminetetraacetate | 2 g |
| Ammonium bromide | 170 g |
| Ammonium nitrate | 50 g |
| Glacial acetic acid | 61 ml |
| Made up to 1 liter in total with addition of water, adjusted to pH to 3.5 with aqueous ammonia or glacial acetic acid and optionally adjusted so as to maintain the pH of the bleaching tank solution. | |
| Fixing solution and fixing replenishing solution | |
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |
| Made up to 1 liter in total with addition of water and adjusted to pH to 6.5 with glacial acetic acid and aqueous ammonia. | |
| Superstabilizer (stabilizing solution) and replenishing solution of the same | |
| 5-Chloro-2-methyl-4-isothiazolin-3-one | 0.05 g |
| 2-Methyl-4-isothiazolin-3-one | 0.02 g |

-continued

| | |
|---|---|
| 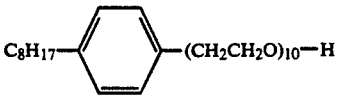 | 2.0 ml |
| Hexamethylenetetramine | 0.5 g |
| 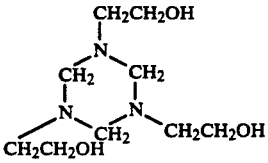 | 0.3 g |
| Made up to 1 liter in total with addition of water and adjusted to pH to 7.0 with potassium hydroxide or 50% sulfuric acid. | |

The results are shown in Table 6.

TABLE 6

| Processing solution No. | Water-soluble surfactant | Fixing and adhering state |
|---|---|---|
| 6 - 1 | — | Δ |
| 6 - 2 | I - 5 | ◎ |
| 6 - 3 | I - 34 | ◎ |
| 6 - 4 | I - 37 | ◎ |
| 6 - 5 | V - 3 | ◎ |
| 6 - 6 | V - 8 | ◎ |

As clearly seen form Table 6, it can be understood that fixing and adhering can be prevented by using the water-soluble surfactant of the present invention. Further, by using PDTAFe(III) in the bleaching solution and a thiocyanate as the fixing agent, fixing and adhering can further prevented as compared with the results in Example 7.

EXAMPLE 9

The same evaluation was carried out as in Example 7 except for changing the material used for a cross-over rack and a rack for transporting to be used in the fixing bath and a cross-over rack from the fixing bath to the super stabilizer bath of the automatic processor KP-40 (trade name, produced by KONICA CORPORATION) used in Example 7 to a polypropylene type resin, polyethylene type resin, fluorine type resin such as Teflon TFE, Neflon PFA, Teflon EPE and Neflon VDF (all trade names), polymethyl acrylate resin, polymethyl methacrylate resin, polyethyl acrylate resin, vinyl chloride-methyl acrylate copolymer resin or vinyl chloride-methyl methacylate copolymer resin, respectively.

As the results, fixing and adhering state can be further prevented with a degree of 1 to 2 ranks, particularly a fluorine type resin and polypropylene type resin gave good results.

EXAMPLE 10

The same evaluation as in Example 8 was carried out except for changing the bleaching solution and bleaching replenishing solution, fixing solution and fixing replenishing solution used in Example 8 to those as mentioned below.

| | |
|---|---|
| Bleaching solution | |
| Potassium ferric 1,3-diaminopropanetetra- | 0.35 mole |

-continued

| | |
|---|---|
| acetate | |
| Disodium ethylenediaminetetraacetate | 2.0 g |
| Potassium bromide | 150 g |
| Glacial acetic acid | 20 ml |
| Potassium nitrate | 40 g |
| Made up to 1 liter in total with addition of water and adjusted to pH to 4.5 with glacial acetic acid or triethanolamine. | |
| Bleaching replenishing solution | |
| Potassium ferric 1,3-diaminopropanetetra-acetate | 0.40 mole |
| Disodium ethylenediaminetetraacetate | 2.0 g |
| Potassium bromide | 170 g |
| Potassium nitrate | 50 g |
| Glacial acetic acid | 40 ml |
| Made up to 1 liter in total with addition of water, adjusted to pH to 3.5 with glacial acetic acid or triethanolamine. | |
| Fixing solution and fixing replenishing solution | |
| Potassium thiosulfate | 110 g |
| Potassium thiocyanate | 160 g |
| Sodium sulfite | 20 g |
| Disodium ethylenediaminetetraacetate | 1.0 g |
| Made up to 1 liter in total with addition of water and adjusted to pH to 6.5 with glacial acetic acid. | |

As the results of the evaluations, the same effects as in Example 8 can be obtained, and bleaching fog is lowered with the degree of 0.01 to 0.03 in KONICA GX-II and no bad smell whereby good results can be obtained.

EXAMPLE 11

On a paper support one surface of which is laminated with a polyethylene and the other surface of which is laminated with a polyethylene containing titanium oxide as a first layer, each layer having a constitution as mentioned below was coated to prepare a multi-layer light-sensitive silver halide color photographic material (1). The coating solutions are prepared as shown below.

First layer coating solution

To 6.67 g of a high boiling point organic solvent (DNP) were added 26.7 g of a yellow coupler (Y - 1), 10.0 g of a dye image stabilizer (ST - 1), 6.67 g of the same (ST - 2) and 0.67 g of an additive (HQ - 1), and the mixture was dissolved by adding 60 ml of ethyl acetate. The solution was emulsified in 220 ml of a 10% gelatin aqueous solution containing 7 ml of a 20% surfactant (SU - 1) by using an ultrasonic homogenizer to prepare a yellow coupler dispersion. This dispersion was mixed with a blue-sensitive silver halide emulsion (containing 10 g of silver) prepared by the following conditions to prepare a first layer coating solution.

The second layer to the seventh layer coating solutions are also prepared in the same manner as in the above first layer coating solution.

| Layer | Constitution | Amount added ($g/m^2$) |
|---|---|---|
| Seventh Layer (Protective layer) | Gelatin | 1.0 |
| Sixth layer (UV ray absorbing layer) | Gelatin | 0.4 |
| | UV absorber (UV-1) | 0.20 |
| | UV absorber (UV-2) | 0.20 |
| | Antistain agent (HQ-1) | 0.01 |
| | DNP | 0.2 |
| | PVP | 0.03 |
| | Irradiation preventive dye (AI-2) | 0.02 |
| Fifth layer (Red-sensitive layer) | Gelatin | 1.30 |
| | Red-sensitive silver chlorobromide emulsion (Em C) calculated on silver | 0.21 |
| | Cyan coupler (C-1) | 0.17 |
| | Cyan coupler (C-2) | 0.25 |
| | Dye image stabilizer (ST-1) | 0.20 |
| | Antistain agent (HQ-1) | 0.01 |
| | HBS-1 | 0.20 |
| | DOP | 0.20 |
| Fourth layer (UV ray absorbing layer) | Gelatin | 0.94 |
| | UV absorber (UV-1) | 0.40 |
| | UV absorber (UV-2) | 0.10 |
| | Antistain agent (HQ-1) | 0.03 |
| | DNP | 0.40 |
| Third layer (Green-sensitive layer) | Gelatin | 1.40 |
| | Green-sensitive silver chlorobromide emulsion (Em B) calculated on silver | 0.17 |
| | Magenta coupler (M-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Irradiation preventive dye (AI-1) | 0.01 |
| Second layer (Intermediate layer) | Gelatin | 1.20 |
| | Antistain agent (HQ-2) | 0.12 |
| | DIDP | 0.15 |
| First layer (Blue-sensitive layer) | Gelatin | 1.20 |
| | Blue-sensitive silver chlorobromide emulsion (Em A) calculated on silver | 0.26 |
| | Yellow coupler (Y-1) | 0.80 |
| | Dye image stabilizer (ST-1) | 0.30 |
| | Dye image stabilizer (ST-2) | 0.20 |
| | Antistain agent (HQ-1) | 0.02 |
| | Irradiation preventive dye (AI-3) | 0.01 |
| | DNP | 0.20 |
| Support | Polyethylene laminated paper | |

-continued
Y-1
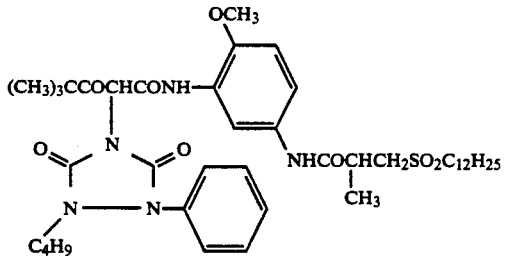
M-1
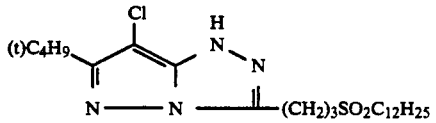
C-1
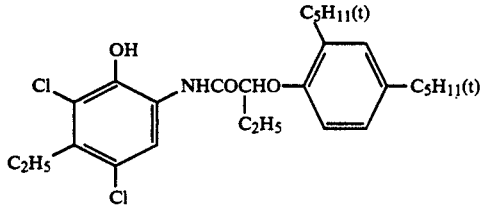
C-2
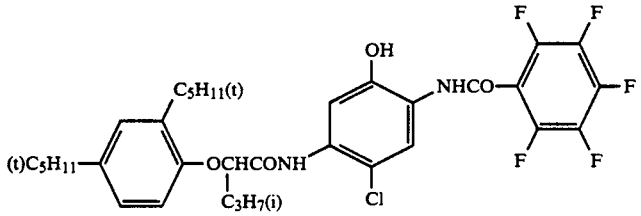
ST-1
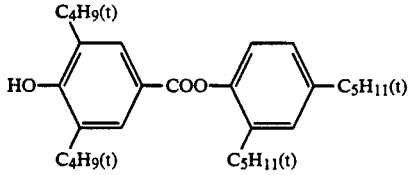
ST-2
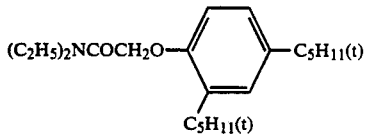
UV-1
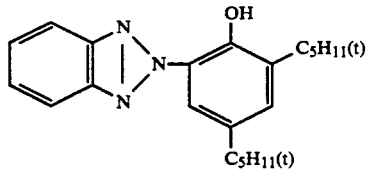
UV-2
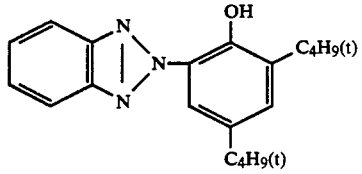
DOP Dioctylphthalate
DNP Dinonylphthalate
DIDP Diisodecylphthalate
PVP Polyvinylpyrrolidone -continued
HBS-1
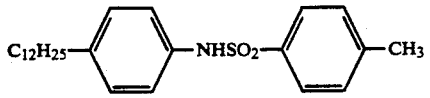
HQ-1
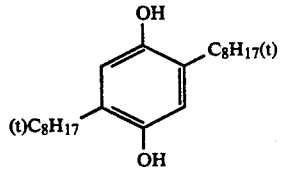
HQ-2
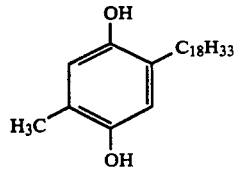
SU-1
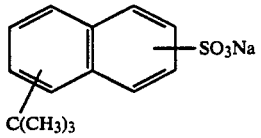
ST-3
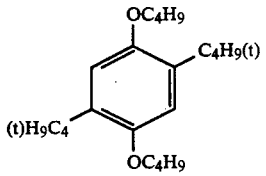
ST-4
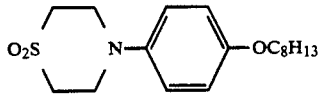
ST-5
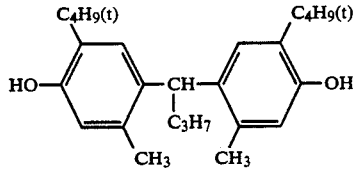
AI-1
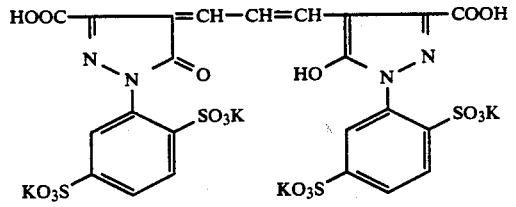
AI-2
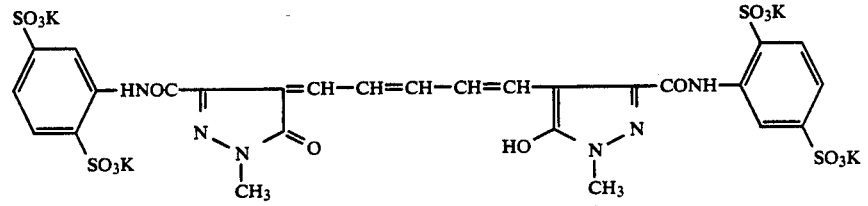

-continued

AI-3

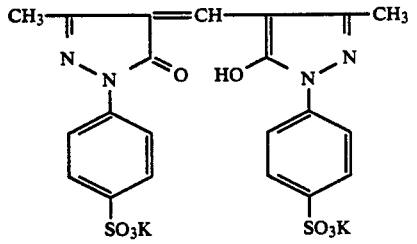

As the hardener, the following H - 1 was used.

H-1

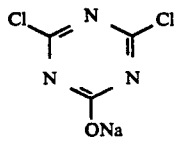

Preparation method of blue-sensitive silver halide emulsion

In 1000 ml of a 2% gelatin aqueous solution maintained at 40° C. were added simultaneously the following (Solution A) and (Solution B) while controlling a pAg=6.5 and a pH=3.0 over 30 minutes and further added simultaneously the following (Solution C) and (Solution D) while controlling a pAg=7.3 and a pH=5.5 over 180 minutes.

At this time, control of the pAg was carried out according to the method described in Japanese Provisional Patent Publication No. 45437/1984, and control of the pH was carried out by using an aqueous solution of sulfuric acid and sodium hydroxide.

| | |
|---|---|
| (Solution A) | |
| Sodium chloride | 3.42 g |
| Potassium bromide | 0.03 g |
| Made up to 200 ml with addition of water. | |
| (Solution B) | |
| Silver nitrate | 10 g |
| Made up to 200 ml with addition of water. | |
| (Solution C) | |
| Sodium chloride | 102.7 g |
| Potassium bromide | 1.0 g |
| Made up to 600 ml with addition of water. | |
| (Solution D) | |
| Silver nitrate | 300 g |
| Made up to 600 ml with addition of water. | |

After completion of addition, desalting was carried out by using a 5% aqueous solution of Demol N (trade name, available from Kao Atlas Co.) and a 20% aqueous magnesium sulfate solution, and then the mixture was mixed with a gelatin aqueous solution to prepare a monodispersed cubic emulsion EMP - 1 having an average diameter of 0.85 μm, a variation coefficient ($\sigma/r$)=0.07 and a silver chloride content of 99.5 mole %.

To the above emulsion EMP - 1 was subjected chemical ripening at 50° C. for 90 minutes by using the following compounds to obtain a blue-sensitive silver halide emulsion (Em A).

| | |
|---|---|
| Sodium thiosulfate | 0.8 mg/mole AgX |
| Chloroauric acid | 0.5 mg/mole AgX |
| Stabilizer SB - 5 | $6 \times 10^{-4}$ mole/mole AgX |
| Sensitizing dye D - 1 | $4.3 \times 10^{-4}$ mole/mole AgX |
| Sensitizing dye D - 4 | $0.7 \times 10^{-4}$ mole/mole AgX |

Preparation method of green-sensitive silver halide emulsion

In the same manner as in preparation of EMP - 1 except for changing an addition time of (Solution A) and (Solution B) and an addition time of (Solution C) and (Solution D), a monodispersed cubic emulsion EPM - 2 having an average diameter of 0.43 μm, a variation coefficient ($\sigma/r$)=0.08 and a silver chloride content of 99.5 mole % was obtained.

To the above emulsion EMP - 2 was subjected chemical ripening at 55° C. for 120 minutes by using the following compounds to obtain a blue-sensitive silver halide emulsion (Em B).

| | |
|---|---|
| Sodium thiosulfate | 1.5 mg/mole AgX |
| Chloroauric acid | 1.0 mg/mole AgX |
| Stabilizer SB - 5 | $6 \times 10^{-4}$ mole/mole AgX |
| Sensitizing dye D - 2 | $4 \times 10^{-4}$ mole/mole AgX |

Preparation method of red-sensitive silver halide emulsion

In the same manner as in preparation of EMP - 1 except for changing an addition time of (Solution A) and (Solution B) and an addition time of (Solution C) and (Solution D), a monodispersed cubic emulsion EPM - 3 having an average diameter of 0.50 μm, a variation coefficient ($\sigma/r$)=0.08 and a silver chloride content of 99.5 mole % was obtained.

To the above emulsion EMP - 3 was subjected chemical ripening at 60° C. for 90 minutes by using the following compounds to obtain a red-sensitive silver halide emulsion (Em C).

| | |
|---|---|
| Sodium thiosulfate | 1.8 mg/mole AgX |
| Chloroauric acid | 2.0 mg/mole AgX |
| Stabilizer SB-5 | $6 \times 10^{-4}$ mole/mole AgX |
| Sensitizing dye D-3 | $1.0 \times 10^{-4}$ mole/mole AgX |
| D-1 | |

-continued

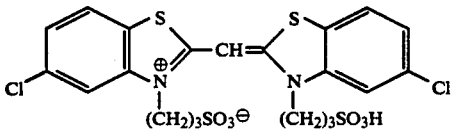

D-2

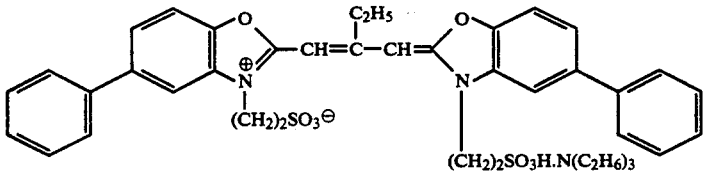

D-3

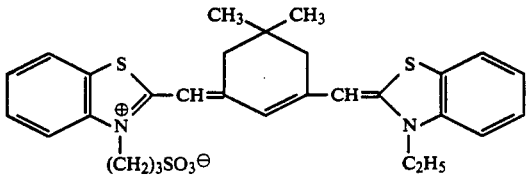

D-4

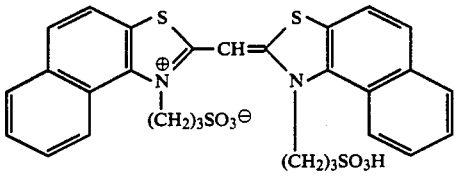

D-5

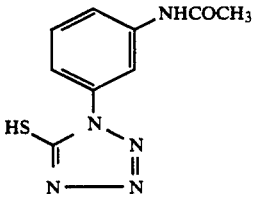

This sample was exposed according to the conventional manner, and then, processings were carried out by using the following processing steps and processing solutions.

| Processing steps | | | |
|---|---|---|---|
| (1) | Color development | 35.0 ± 0.3° C. | 45 sec |
| (2) | Bleaching | 35.0 ± 0.5° C. | 45 sec |
| (3) | Fixing | 35.0 ± 0.5° C. | 45 sec |
| (4) | Stabilizing (3 tanks cascade) | 30 to 34° C. | 90 sec |
| (5) | Drying | 60 to 80° C. | 30 sec |

| Color developing tank solution | |
|---|---|
| Triethanolamine | 10 g |
| Ethylene glycol | 1 g |
| N,N-Diethylhydroxylamine | 3.6 g |
| Hydrazinodiacetic acid | 5.0 g |
| Potassium bromide | 20 mg |
| Potassium chloride | 2.5 g |
| Diethylenetriaminepentaacetic acid | 5 g |
| Potassium sulfite | $5.0 \times 10^{-4}$ mole |
| Color developing agent (3-Methyl-4-amino-N-ethyl-N-(β-methanesulfonamidoethyl) aniline sulfate) | 5.5 g |

-continued

| | |
|---|---|
| Potassium carbonate | 25 g |
| Potassium hydrogen carbonate | 5 g |
| Made up to 1 liter in total with addition of water, and adjusted to pH to 10.10 with potassium hydroxide or sulfuric acid. | |
| **Color developing replenishing solution** | |
| Triethanolamine | 14.0 g |
| Ethylene glycol | 8.0 g |
| N,N-Diethylhydroxylamine | 5 g |
| Hydrazinodiacetic acid | 7.5 g |
| Potassium bromide | 8 mg |
| Potassium chloride | 0.3 g |
| Diethylenetriaminepentaacetic acid | 7.5 g |
| Potassium sulfite | $7.0 \times 10^{-4}$ mole |
| Color developing agent (3-Methyl-4-amino-N-ethyl-N-(β-methanesulfonamidoethyl) aniline sulfate) | 8 g |
| Potassium carbonate | 30 g |
| Potassium hydrogen carbonate | 1 g |
| Made up to 1 liter in total with addition of water, and adjusted to pH to 10.40 with potassium hydroxide or sulfuric acid. | |
| **Bleaching solution** | |
| Potassium ferric 1,3-diaminopropanetetra- | 0.10 mole |

-continued

| | |
|---|---|
| acetate | |
| Disodium ethylenediaminetetraacetate | 1.0 g |
| Potassium bromide | 50 g |
| Glacial acetic acid | 20 ml |
| Potassium nitrate | 30 g |
| Made up to 1 liter with addition of water and adjusted to pH to 4.5 with glacial acetia acid. | |
| Bleaching replenishing solution | |
| Potassium ferric 1,3-diaminopropanetetra-acetate | 0.12 mole |
| Disodium ethylenediaminetetraacetate | 1.0 g |
| Potassium bromide | 60 g |
| Glacial acetic acid | 15 ml |
| Made up to 1 liter with addition of water and adjusted to pH to 3.5 with glacial acetia acid. | |
| Fixing solution and fixing replenishing solution | |
| Potassium thiosulfate | 60 g |
| Potassium sulfite | 20 g |
| Disodium ethylenediaminetetraacetate | 1.0 g |
| Made up to 1 liter with addition of water and adjusted to pH to 6.5 with glacial acetic acid. | |
| Stabilizing tank solution and replenishing solution | |
| Orthophenylphenol | 0.1 g |
| Ubitex (trade name, available from Ciba Geigy AG) | 1.0 g |
| $ZnSO_4.7H_2O$ | 0.2 g |
| Ammonium sulfite (40 % solution) | 5.0 ml |
| 1-Hydroxyethylidene-1,1-diphosphonic acid (60% solution) | 2.0 g |
| Ethylenediaminetetraacetic acid | 1.0 g |
| Made up to 1 liter with addition of water as well as adjusted to pH to 7.8 with aqueous ammonia or sulfuric acid. | |

Using the color paper and processing solutions thus prepared, running processing was carried out.

The running processing was carried out by filling the above color developing solution in an automatic processor and also filling the bleaching tank solution, the fixing tank solution and the stabilizing tank solution, and while processing the above color paper sample and supplementing the above color developing replenishing solution, the bleaching replenishing solution, the fixing replenishing solution and the stabilizing replenishing solution through a quantitative pump every 3 minutes interval.

As a replenishing amount in the color developing tank, 100 ml thereof was replenished per 1 $m^2$ of the color paper, as a replenishing amount in the bleaching tank, 220 ml of the bleaching replenishing solution per 1 $m^2$ of the same, as a replenishing amount in the fixing tank, 220 ml of the fixing replenishing solution per 1 $m^2$ of the same and as a replenishing amount in the stabilizing tank, 250 ml of the stabilizing replenishing solution per 1 $m^2$ of the same, respectively.

The running processing was carried out until an amount of the color developing solution replenished in the color developing tank solution becomes 3-times of the volume of the color developing tank solution with a continuous processing of 0.05R per day. IR herein mentioned means that the color developing replenishing solution was replenished with the same amount as the color developing tank volume. After continuous processing, fixing and adhering state at the fixing tank and a cross-over portion from the fixing tank to the stabilizing tank were observed. The results are shown in Table 7.

TABLE 7

| Processing solution No. | Water-soluble surfactant | Fixing and adhering state |
|---|---|---|
| 7 - 1 | — | X |
| 7 - 2 | I - 5 | ◎ |
| 7 - 3 | I - 34 | ◎ |
| 7 - 4 | I - 37 | ◎ |
| 7 - 5 | V - 3 | ◎ |
| 7 - 6 | V - 8 | ◎ |

As clearly seen from Table 7, it can be understood that in the processing of a color paper, fixing and adhering can be prevented by using the water-soluble surfactant of the present invention.

Also, when the surfactants used in Example 1 were evaluated in the same manner as mentioned above. As the results, the same effects can be confirmed.

EXAMPLE 12

The same evaluation was carried out as in Example 11 except for pouring overflow solutions of the bleaching solution and the fixing solution used in Example 10 into the bleaching solution and the fixing solution tanks for a color paper used in Example 11.

As the results, fixing and adhering state can be a little further prevented as compared with those of Example 11 and yet the minimum density is also lowered with a degree of 0.01 to 0.02.

We claim:

1. A processing method of a light-sensitive silver halide color negative film photographic material which comprises, after image-wise exposure, subjecting a light-sensitive silver halide color photographic material to a color developing, bleaching and fixing processing, followed by washing or stabilizing processing, the improvement wherein a fixing solution used in the fixing processing contains a water-soluble surfactant selected from the group consisting of surfactants represented by formula (I) and (V) presented below, said surfactant being present in an amount of 0.05 to 10 g/l, and an amount of thiosulfate in the range of 0.2 mole/liter to 3.0 mole/liter; and, during processing, the fixing solution is replenished in an amount of 20 to 1000 ml per 1 $m^2$ of the light-sensitive material;

Formula (I):

$$A_2—O—(B)_m—(C)_n—X_1 \quad (I)$$

wherein $A_2$ represents a monovalent organic group selected from the group consisting of an alkyl group having 6 to 50 carbon atoms, and an aryl group substituted by an alkyl group having 3 to 35 carbon atoms or by an alkenyl group having 2 to 35 carbon atoms, and $X_1$ is hydrogen;

Formula (V):

$$A_2—O\text{-}(CH_2CH_2O)_n\text{-}SO_3M \quad (V)$$

wherein M represents an alkali metal, n is 1 to 100, $A_2$ represents a monovalent organic group selected form the group consisting of an alkyl group having 6 to 20 carbon atoms, and an aryl group substituted by an alkyl group having 3 to 20 carbon atoms, B or C is ethylene oxide or propylene oxide, or $$—(CH_2)_{n1}—(\underset{\underset{OH}{|}}{CH})_{m1}—(CH_2)_{l1}—O—$$

wherein $n_1$, $m_1$ and $l_1$ each represent 0, 1, 2 or 3; and m and n each represent an integer of 0 to 100.

2. The method according to claim 1 wherein a bleaching agent contained in a bleaching solution is a ferric complex salt represented by the formula (A) or (B):

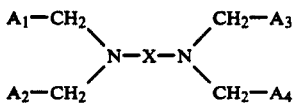

(A)

wherein $A_1$ to $A_4$ may be the same or different and each represent $-CH_2OH$, $-COOM$ or $-PO_3M_1M_2$, where M, $M_1$ and $M_2$ each represent a hydrogen atom, an alkali metal or an ammonium; and X represents a substituted or unsubstituted alkylene group having 3 to 6 carbon atoms.

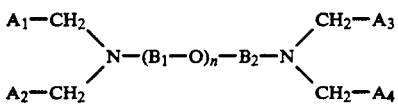

(B)

wherein $A_1$ to $A_4$ have the same meanings as defined in the above formula (A); n is an integer of 1 to 8; $B_1$ and $B_2$ may be the same or different and each represent a substituted or unsubstituted alkylene group having 2 to 5 carbon atoms.

3. The method according to claim 1 wherein the fixing solution contains 0.8 to 2.5 mole/liter of a thiosulfate.

4. The method according to claim 1 wherein said fixing solution contains a soluble ferric complex salt in an amount of $5\times10^{-2}$ mole/liter or less.

5. The method according to claim 4 wherein said fixing solution contains a thiocyanate in an amount of 0.1 to 3.0 mole/liter.

6. The method according to claim 1 wherein said fixing solution contains a thiocyanate in an amount of 0.1 to 3.0 mole/liter.

7. The method according to claim 2 wherein said fixing solution contains soluble ferric complex salt in an amount of $5\times10^{-2}$ mole/liter or less.

8. The method according to claim 7 wherein said fixing solution contains a thiocyanate in an amount of 0.1 to 3.0 mole/liter.

9. The method of claim 8 wherein said fixing solution contains 0.1 to 8 g/l surfactant.

10. The method of claim 2 wherein said fixing solution contains 0.1 to 8 g/l surfactant.

11. The method of claim 1 wherein said fixing solution contains 0.1 to 8 g/l surfactant.

12. A processing method of a light-sensitive silver halide color photographic material which comprises, after image-wise exposure, subjecting a light-sensitive silver halide color photographic material to a color developing, bleaching and fixing, followed by washing or stabilizing processing, the improvement wherein said color photographic material is a color negative film, a fixing solution used in the fixing processing contains a water-soluble surfactant represented by the formula (I) presented below, said surfactant being present in an amount of 0.05 to 10 g/l, and an amount of thiosulfate in the range of 0.2 mole/liter to 3.0 mole/liter; and, during processing, the fixing solution is replenished in an amount of 20 to 1000 ml per 1 $m^2$ of the light-sensitive material;

Formula (I):

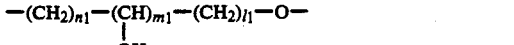

(I)

wherein $A_2$ represents a monovalent organic group selected from the group consisting of an alkyl group having 6 to 50 carbon atoms, and an aryl group substituted by an alkyl group having 3 to 35 carbon atoms or by an alkenyl group having 2 to 35 carbon atoms;

B or C is ethylene oxide or propylene oxide, or wherein $n_1$, $m_1$ and $l_1$ each represent 0, 1, 2 or 3;

m and n each represent an integer of 0 to 100; and $X_1$ is a hydrogen atom.

13. The method according to claim 12 wherein said surfactant is a compound wherein $A_2$ is a monovalent organic group selected form the group consisting of an alkyl group having 6 to 50 carbon atoms.

14. The method according to claim 13 wherein said surfactant is a compound wherein B is ethylene oxide, C is propylene oxide and $n_1$, $m_1$ and $l_1$ each represent 1, 2 or 3.

15. The method according to claim 13 wherein said surfactant is a compound wherein B is ethylene oxide, m represents an integer of 1 to 100 and n is 0.

16. The method according to claim 12 wherein said surfactant is a compound wherein $A_2$ is an aryl group substituted by an alkyl group having 3 to 35 carbon atoms.

17. The method according to claim 16 wherein said surfactant is a compound wherein B is ethylene oxide, C is propylene oxide and $n_1$, $m_1$ and $l_1$ each represent 1, 2 or 3.

18. The method according to claim 16 wherein said surfactant is a compound wherein B is ethylene oxide, m represents an integer of 1 to 100 and n is 0.

19. The method according to claim 12 wherein said surfactant is a compound wherein $A_2$ is an aryl group substituted by an alkenyl group having 2 to 35 carbon atoms.

20. The method according to claim 19 wherein said surfactant is a compound wherein B is ethylene oxide, C is propylene oxide and $n_1$, $m_1$ and $l_1$ each represent 1, 2 or 3.

21. The method according to claim 19 wherein said surfactant is a compound wherein B is ethylene oxide, m represents an integer of 1 to 100 and n is 0.

22. A processing method of a light-sensitive silver halide color photographic material which comprises, after image-wise exposure, subjecting a light-sensitive silver halide color photographic material to a color developing, bleaching and fixing, followed by washing or stabilizing processing, the improvement wherein said color photographic material is a color negative film, a fixing solution used in the fixing processing contains a water-soluble surfactant represented by the formula (V) presented below, said surfactant being present in an amount of 0.05 to 10 g/l, and an amount of thiosulfate in the range of 0.2 mole/liter to 3.0 mole/liter; and, during processing, the fixing solution is replenished in an amount of 20 to 1000 ml per 1 $m^2$ of the light-sensitive material;

Formula (V):

$$A_2—O—(CH_2CH_2O)_n—SO_3M \quad (V)$$

wherein M represents an alkali metal, n is 1 to 100, $A_2$ represents a monovalent organic group selected form the group consisting of an alkyl group having 6 to 20 carbon atoms, and an aryl group substituted by an alkyl group having 3 to 20 carbon atoms.

* * * * *